US010669809B2

(12) United States Patent
Bowen, Jr. et al.

(10) Patent No.: US 10,669,809 B2
(45) Date of Patent: Jun. 2, 2020

(54) TEST-PORT ACTIVATED TUBING HANGER CONTROL VALVE

(71) Applicants: Billy A Bowen, Jr., Choctaw, OK (US); Jason Lee Bowen, Marion, ND (US)

(72) Inventors: Billy A Bowen, Jr., Choctaw, OK (US); Jason Lee Bowen, Marion, ND (US)

( * ) Notice: Subject to any disclaimer, the term of this patent is extended or adjusted under 35 U.S.C. 154(b) by 80 days.

(21) Appl. No.: 15/638,685

(22) Filed: Jun. 30, 2017

(65) Prior Publication Data

US 2018/0003002 A1 Jan. 4, 2018

Related U.S. Application Data

(63) Continuation of application No. PCT/US2017/040147, filed on Jun. 29, 2017.

(60) Provisional application No. 62/357,232, filed on Jun. 30, 2016.

(51) Int. Cl.
*E21B 34/02* (2006.01)
*E21B 33/04* (2006.01)

(52) U.S. Cl.
CPC ..... *E21B 34/02* (2013.01); *E21B 33/04* (2013.01)

(58) Field of Classification Search
CPC ..... E21B 34/02; E21B 33/04
See application file for complete search history.

(56) References Cited

U.S. PATENT DOCUMENTS

| | | | | |
|---|---|---|---|---|
| 2,905,246 | A | 9/1959 | Rodgers | |
| 2,959,187 | A * | 11/1960 | Boyle | E21B 34/02 137/456 |
| 3,713,485 | A * | 1/1973 | Holbert, Jr. | E21B 34/02 137/466 |
| 4,736,799 | A | 4/1988 | Ahlstone | |
| 5,415,378 | A | 5/1995 | Craven | |
| 5,465,794 | A | 11/1995 | McConaughy et al. | |
| 5,544,707 | A | 8/1996 | Hopper et al. | |
| 5,706,893 | A | 1/1998 | Morgan | |
| 6,119,773 | A | 9/2000 | Gariepy et al. | |
| 6,345,668 | B1 | 2/2002 | Reilly | |
| 6,453,995 | B2 | 9/2002 | Gatherar et al. | |
| 6,470,971 | B1 | 10/2002 | Bridges | |
| 6,497,277 | B2 | 12/2002 | Cunningham et al. | |
| 6,729,392 | B2 | 5/2004 | DeBerry et al. | |
| 7,275,591 | B2 | 10/2007 | Allen et al. | |
| 8,434,560 | B2 | 5/2013 | Baskett et al. | |

(Continued)

*Primary Examiner* — D. Andrews
(74) *Attorney, Agent, or Firm* — Sarah J. Rhoades

(57) ABSTRACT

A pressure control valve located in an improved tubing hanger of an oil or gas wellhead. The pressure valve having in-line communication with the production bore and having pressure activation. The pressure activation is imparted by utilizing hydraulic pressure input through the existing test port into the tubing head adapter void space. The pressure actuates the in-line wellhead control valve in a safer, more efficient, and less expensive manner than current industry practices and provides a barrier to pressurized hydrocarbons, both liquid and gas, produced by the well. The control valve eliminates the need for a lubricator and expensive specialized equipment. The valve is easily operated by a standard hydraulic hand pump through the existing test port of the tubing head adapter, and fits inside the tubing hanger.

24 Claims, 19 Drawing Sheets

(56) References Cited

U.S. PATENT DOCUMENTS

| | | | | |
|---|---|---|---|---|
| 8,668,004 | B2 | 3/2014 | June et al. | |
| 8,746,350 | B2 | 6/2014 | Bryson | |
| 9,611,717 | B2 | 4/2017 | Lockwood | |
| 9,624,747 | B2 | 4/2017 | Kajaria et al. | |
| 2002/0153143 | A1* | 10/2002 | Compton | E21B 33/043 166/368 |
| 2003/0136556 | A1 | 7/2003 | Cornelssen et al. | |
| 2012/0205123 | A1 | 8/2012 | Kennedy | |
| 2013/0299162 | A1* | 11/2013 | Soltvedt | E21B 21/106 166/244.1 |
| 2015/0315869 | A1 | 11/2015 | Landry | |

* cited by examiner

C-C

D-D

E-E

TEST-PORT ACTIVATED TUBING HANGER CONTROL VALVE

CROSS-REFERENCE TO RELATED APPLICATIONS

This patent application claims priority under 35 U.S.C. § 119(e) to U.S. Patent Application Ser. No. 62/357,232 entitled "Pressure control valve located in the tubing hanger of an oil or gas well" and filed on Jun. 30, 2016 by Jason Lee Bowen. The entire disclosure of that provisional patent application is hereby incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to oil and gas well production systems, and more particularly to valves used to maintain well control during maintenance or removal of pressure control equipment at or above the tubing head.

2. Description of the Related Art

Oil wells and gas wells are drilled and then the well bore must be secured for later or controllable production use of the well. The well has inherent pressure that is produced when the formation is tapped. The pressure must be harnessed by wellhead assemblies. Wellhead assemblies provide support hangers for suspending production tubing and casings into the well bore, typically at or below the ground level. Wellhead assemblies also typically include a wellhead housing adjacent to where the casing and tubing enter the well bore and a production tree atop the wellhead housing. The production tree includes a tubing head adapter at the top of the production string. Other features of the wellhead include a cap and gauge and a series of valves, chokes, and adapters.

When installed, a standard tubing hanger has an outer mating surface which mates with the inner mating surface of the wellhead member by seals. The sealing connection between the tubing hanger hydraulic fluid passage and the wellhead member hydraulic fluid passage is accomplished by the use of two circumferential annular seals. One seal extends around the circumference of the tubing hanger just above the lateral openings of the hydraulic fluid passages in the tubing hanger and wellhead member. Another seal extends around the circumference of the tubing hanger just below the lateral openings of the hydraulic fluid passages of the tubing hanger and wellhead member. Each of these two seals forms an annular seal between the circumference of the tubing hanger and the wellhead member so as to isolate an annular void between the tubing hanger and the wellhead member through which the hydraulic fluid passages can communicate. Prior art teaches that it is difficult to create reliable circumferential annular seals between the tubing hanger and wellhead member, especially for high pressure applications.

A typical tubing hanger has nothing inside but is a solid steel bore with a tapered outer diameter to secure the production tubing in the wellhead essentially acting like a large nut with no internal components or moving parts. A production fluid passage extends through the tubing hanger for placing the production tubing string in communication with a production line which may be comprised of strings of tubes totaling 10,000 feet and more than 70,000 pounds. The typically 2 and ⅞ inch diameter production tubing inserts into the typically 5 to 7 inch casing with the space in between defining an annulus. The tubing string (which may be coiled tubing instead of production tubing) might be suspended by other connectors such as welding or slip lock connectors as is known in the art.

Industry standards call for a test port about one-eight inch in diameter and located in the tubing head adaptor allowing for the wellhead seals to be tested by the introduction of hydraulic test pressure. Fluid introduced into test ports also tests the security of the seal provided by ring gaskets. Typically test ports are provided so that independent sequential testing of all of the sealing elements may be accomplished. Due to the large diameters involved, and the harsh conditions encountered during installation and well operation, the industry has believed that it is difficult to create reliable circumferential annular seals between the tubing hanger and wellhead member, especially for high pressure applications. The test ports are typically used to apply up to 10,000 pounds of pressure and make sure it holds for 10 minutes in order to confirm the seals are working. Also, since the tubing hanger is often landed into the wellhead member under imperfect conditions, preventing seal damage during, and prior to, installation has also been a concern and must be confirmed safe through testing.

Pressure from the well is moderated in the tree by a series of valves including a swab valve, production wing valve, and an upper master valve and lower master valve. The tree is not well equipped to cut off the pressure at the base of wellhead yet occasionally that is exactly what must be done when parts above the tubing head adapter must be maintained, replaced, or removed when the well needs to be sealed. It is standard for downhole safety valves to be used in such circumstances. These downhole safety valves are connected into the production tubing string and are designed to shut off flow through the production tubing string. These safety valves are also used in case of a malfunction so as to avoid a blowout. However, the downhole safety valves are difficult to access and dangerous to close. Attempts to provide alternatives to these valves have consistently required the introduction of unnecessary new points of access which increase potential points of mechanical failure and require their own maintenance.

Current methods to secure well control include kill fluid, wireline, or a surface plug set with a lubricator. These methods are often very dangerous, expensive, and time consuming. These methods require trucks, cranes and a crew of technicians. Lubricators in particular are used to set a plug when a well has pressure and they require a crane for operation because they are 12-20 feet long and weigh about 300 pounds.

Although several versions of remotely operable valves for controlling flow through the annulus bore within the tubing hanger have been patented, these valves have for the most part been impractical to implement due to the limited radial cross-sectional area that is available in the tubing hanger for such valves. It is taught that relocation of the valves from the tree to the tubing hanger is difficult due to the size of the valves. "[T]he space required to accommodate [gate valves or ball] valves dictates larger tubing hanger and wellhead designs, with increased capital costs, increased component handling difficulties and hence increased operation costs." U.S. Pat. No. 6,453,995. For attempts to locate valves in the tubing hanger ball valves have been preferred due to space constraints. U.S. Pat. No. 6,729,392. Most inventions have sought to seal annulus bores. The few attempts to seal the bore within the tubing hanger have failed. Despite the identification of the need for a simple wellhead device to provide for flow control in the production bore of the tubing hanger, the in-line bore valve has not yet been successful. The attempts have exclusively employed ball valves and their own cumbersome techniques. They have not avoided adding new access points which add new risks and new weaknesses in an already sensitive and dangerous system.

None of the attempts to provide a valve for the tubing hanger have been accepted because they are too difficult to operate and have added new pressure lines to the wellhead and required at least two access ports, one to open the valve and one to close the valve. These requirements insert more seals and points of maintenance or failure. A need exists for a simplified tubing hanger control valve.

BRIEF SUMMARY OF THE INVENTION

A new method is provided to seal a well bore production tubing string at the tubing hanger by using a test port to actuate a control valve in-line with the well bore. This novel manner of controlling pressure within the wellhead is new, safe, inexpensive, reliable and efficient. The method comprises using a pressure control valve located in the tubing hanger of an oil or gas well wherein the valve is in communication with the test port of the tubing head adapter. The valve is located within the improved tubing hanger of the present invention and in direct line with the well bore. The control valve comprises a housing body, a transfer component such as a ring piston, at least one workpiece to move a seal between an open and closed position, and a seal. The housing body preferably has at least two joinable members. The improved tubing hanger may also have a hanger neck and a flow piece to provide support to the valve.

The present invention utilizes an existing seal testing port as the pathway to introduce pressure and activate the test-port pressure actuated sealing apparatus in the control valve. Because the seal movement is initiated by the application of pressure applied through the test port, the transfer component moves first and acts upon the workpiece. The workpiece or workpieces then aid in movement of the seal that may include structures such as gate valves within supporting assemblies and with biasing springs or gears. Finally, a coil spring serves as a workpiece to complete seal removal (opening) once the pressure from the test port is released and down bore pressure is added to neutralize the pressure applied on each side of the seal. The control valve components mechanically couple within the joined housing body members. Some components are seated in a manner that allows movement within the housing body in the same axis as the well bore. The seal is secured to allow it to articulate into and out of the path of the bore flow.

The valve is activated by hydraulic or air pressure applied by a hand pump or similar device at the test port. This introduced pressure is communicated to the control valve through the void space between the tubing head adapter and the tubing hanger. When the introduced pressure reaches a level that is greater than the upward well pressure, the control valve is actuated to seal the well bore. The present invention will accomplish in minutes using basic hand tools, what can typically take hours using expensive and dangerous equipment. With the present invention, a single person using a hydraulic hand pump and wrench can gain well control in five to fifteen minutes without need for a crane or a crew.

The present invention is designed to be installed in the tubing head of an oil or gas producing well. A hydraulic hand pump is attached to the test port of the tubing head adapter. A user applies pressure through the test port by pumping the hydraulic pump. The introduced pressure builds in the void space that is in communication with the test port and also in communication with the control valve components. When introduced pressure exceeds the well bore pressure a transfer component moves and imparts force on an actuating mechanism that causes movement of a sealing valve.

The transfer component may be comprised of mechanisms such as a plunger, piston, or similar structure. The actuating mechanism may be comprised of mechanisms such as gears, springs or similar structures. The sealing valve may be a gate or a seal body with a radial cross section to engage the interior surface of the cylindrical walls of the well bore production tubing string.

More specifically, by way of example and not necessarily by way of limitation, in the preferred embodiment a ring piston located on the control valve will move down initiating a series of movements in the control valve. The downward moving piston will shift a gate assembly downward and initiate the movement of the integral gate of the gate assembly to articulate into its default horizontal, well-sealing position. In this closed position, the gate is securely seated in the annular opening of a flow piece of the control valve. The pressure from the well formation retains the gate of the control valve in the horizontal, closed position. With the well bore closed, previously accumulated pressure above the tubing head can be slowly released or bled off. Once the pressure is released, maintenance to the well head above the control valve can commence.

Because the pressure from the well formation is securing the sealing valve, the introduced pressured being applied through the test port can cease. The pressure in the tubing hanger void can be released or bled off through the test port. When the void pressure no longer exceeds the well pressure, the ring piston is no longer forced downward and well pressure may return the ring piston up. Even though the ring piston is no longer forced downward the gate will remain closed by the well pressure until an equalized pressure has been introduced in the central bore above the tubing hanger. Unlike other valves that require two ports, one to open them and one to close them, the present invention utilizes the single test port to apply and release pressure via the tubing head void space.

Assuming formation flow is desired to recommence after the well head tree is once again fully assembled, the sealing valve can be opened. To open the sealing valve, pressure is introduced through existing up-tree valves using a hand pump or available pressure generators. When the down bore pressure equals the pressure pushing up from the well formation, the pressure in the control valve will neutralize. Under these equalized pressure conditions, the coil spring will force the gate assembly upward around the flow piece, also called a flow body. The force from the coil spring on the gate assembly and force of the flow piece against the gate abutting the flow piece will overcome the force of the biasing gate spring and the gate will once again articulate into a position that is parallel to the well production flow. When the gate is parallel it is open and the well formation flow will recommence.

This invention provides the oil and gas drilling industries with a safe and inexpensive way to maintain well control during the maintenance and removal of pressure control equipment located above the tubing hanger. The expense, time and potentially adverse effects of killing the well are avoided. The expense and wireline crew required to set a bridge plug are avoided. The use of the most dangerous operation in wellhead maintenance—using a lubricator—is avoided. This pressure control valve located in the tubing hanger of an oil or gas well comprises a seal, an actuating mechanism, a failsafe mechanism through which the production tubing is safely isolated by applying pneumatic or hydraulic pressure through the existing test port.

The methods of the present invention use hydraulic test pressure in the tubing head adapter void space to actuate an in-line wellhead valve. The methods are safer, more efficient, and less expensive than current industry practices. The present invention eliminates the need for a lubricator and expensive specialized equipment. The valve of the preferred embodiment of the present invention fits inside the tubing hanger, and is easily operated by a standard hydraulic hand pump through the existing test port of the tubing head adapter. None of the attempts by prior inventions to seal the bore within the tubing hanger have employed the test port as a means to actuate the sealing mechanism. The control valve of the present invention will not interfere with the test port's functionality to test the neck seals, body seals and the ring gasket. The difference being that such testing will move the valve to the closed position. This simply requires that the valve be opened again when testing is complete.

The foregoing has outlined, in general, the physical aspects of the invention and is to serve as an aid to better understanding the more complete detailed description which is to follow. About such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

LIST OF REFERENCE NUMERALS

Figure 1:
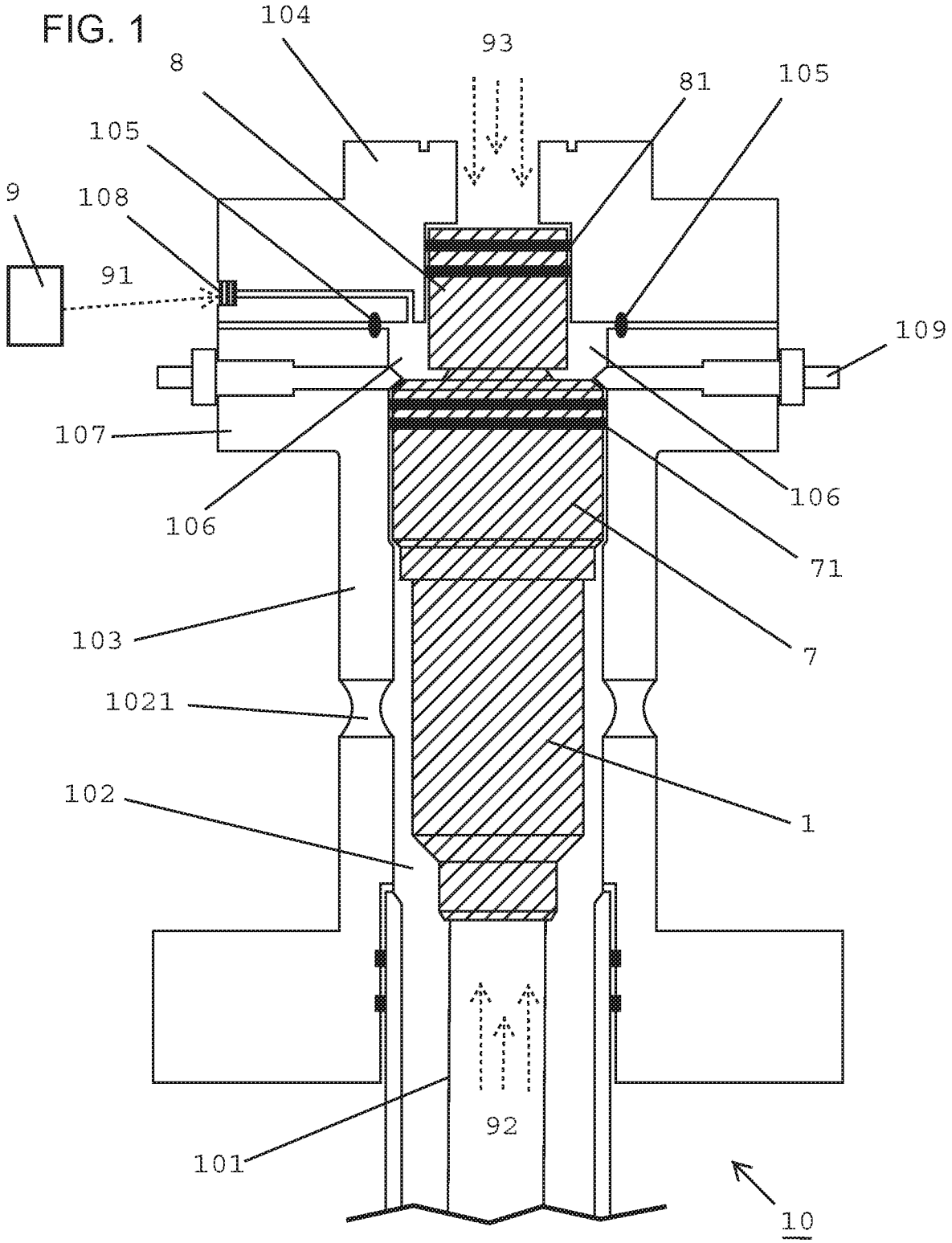
FIG. 1 is an elevation view of one embodiment of the invention installed in the tubing head beneath a wellhead production tree.

200 Valve Assembly or Valve
201 Central Bore
10 Existing well head
101 Existing well bore production tubing
102 Existing Annulus
1021 Existing annulus valve side outlets
103 Existing tubing head
104 Existing tubing head adapter
105 Existing ring gasket
106 Existing void space or hydraulic fluid passage
107 Existing Flanges
108 Existing test-port
109 Existing lock down screws
1 Lower Body
11 Lower body upper threading
12 Lower body seals
13 the lower body shoulder
14 the production tubing threads
15 the gate housing seat
2 Coil Spring
21 Coil spring to gate assembly interface
3 Gate Assembly
31 Gate housing
311 Void in the housing wall
312 Upper ledge
313 Lower ledge
314 Screw holes for bracket
32 Gate
321 Gate arm
322 Hole to receive pin

33 Gate bracket
331 Screw holes
332 Pin holes
34 Gate spring (could be a gear)
341 loop to receive pin
35 Gate pin
351 hole for cotter pin
352 cotter pin
36 Gate bracket screws
37 Gate seal
38 Gate seal notches
4 Flow Piece or Flow Body
41 Flow piece upper seals
42 Flow seal notches
43 Threading
44 Alignment pin receivers
45 Ledge for alignment holes
46 Flow piece passage for vertical port pressure transfer
47 Back-pressure plug threading
48 gate to flow piece seal (keeps particles like sand out of the control valve)
49 lower opening of flow piece central bore tube
5 Alignment Pins (×4)
6 Ring Piston
61 Ring piston seal notches
62 ring piston seals
7 Upper Body
71 Upper body seals
72 Upper body seal notches
73 Upper body passage for vertical port or pressure transfer
74 Alignment holes
75 Upper body threading
8 Hanger Neck
81 Hanger neck seals
82 Hanger seal notches
83 Hanger threading
9 Hydraulic hand pump (shown schematically)
91 Introduced pressure
92 Formation pressure
93 Tree pressure

DETAILED DESCRIPTION OF THE INVENTION

The present invention comprises a unique and nonobvious method of utilizing an existing test port to activate a control valve in-line with the production bore and located in an improved tubing hanger or tubing hanger supplement. In the drawings, a portion of a wellhead 10 is shown with improved structures of the present invention installed therein. During use, the steps of the present method will seal the well bore production tubing string. The steps comprise:

- installing an improved tubing hanger with an internal valve, as described below, within a tubing head 103,
- applying pressure through the test port 108 of the tubing head adapter 104,
- building pressure within the tubing head void space 106 created between the tubing head adapter and the improved tubing hanger,
- overcoming formation pressure 92 Dressing up from the well bore production tubing string 101 with introduced pressure 91 applied through the test port 108 into the void space 106, and
- actuating the in-line sealing apparatus 200 to seal the well bore production tubing string 101.

The sealing apparatus comprises a gate 32 or other articulating sealing apparatus sized to close the central bore 201 in the tubing hanger. The sealing apparatus must also comprise support structures to withstand the well pressure 92 and also includes a means for articulating the gate from an open to a closed position. Desirably, the gate will have the ability to be once again opened to allow flow production to recommence.

With this new method, the test port 108 whether provided in singular or multiple iterations, standard in most tubing head adapters, necessarily takes on a new and unexpected role in well maintenance by serving as an actuating passage for an operational force to the control valve. The tubing hanger of the preferred embodiment could be minimized to include only the workpieces and lower body portions in order to retrofit onto existing tubing hanger necks. In that case, the test port 108 will remain the passage for the applied pressure 91 to the test port void 106 and the remaining operations will be unchanged.

The improved tubing hanger of present invention is installed in any standard tubing head on an oil or gas producing well. The elevation view in FIG. 1 illustrates the preferred embodiment installed within the tubing head 103 and a tubing head adapter 104 of a standard well head 10. The well bore production tubing 101 is suspended from the bottom of the invention. A standard or provided hanger neck 8 sealably joins the tubing head adapter 104 of the tubing head 103. A standard ring gasket 105 between the tubing head flanges 107 isolates the bore from the atmosphere. The upper body 7 is sealably joined with the top of the tubing head 103 to isolate the annulus 102. The annulus 102 is conventionally accessed and controlled through valves at the side outlets 1021. The combination of some industry standard seals with the introduced seals of the present invention create three sealing points which create a void space 106 between the atmosphere, the tubing head adapter 104 and the tubing head 103. The void space 106 holds a volume of about one liter of either air or fluid.

An external source such as a hydraulic hand pump 9 (shown schematically FIG. 1) is used to introduce pressure through the test port 108. In FIG. 1, the introduced pressure is schematically illustrated by arrows labeled with 91. The introduced pressure 91—either air pressure or hydraulic pressure—fills the void space 106 created by the three seals 71, 81, 105. The void space 106 of the preferred embodiment is in communication with only the test port 108 and the displacement transfer component of the control valve 200. Currently the test port 108 is used in the industry for nothing more than a seal-testing mechanism. The features and methods of the present invention create a new and unexpected functionality for the test port 108. Now instead of only testing the seals and gaskets of the tubing head 103 and tubing head adapter 104, the test port 108 will also operate to close the control valve 200 of the present invention.

Figure 2:
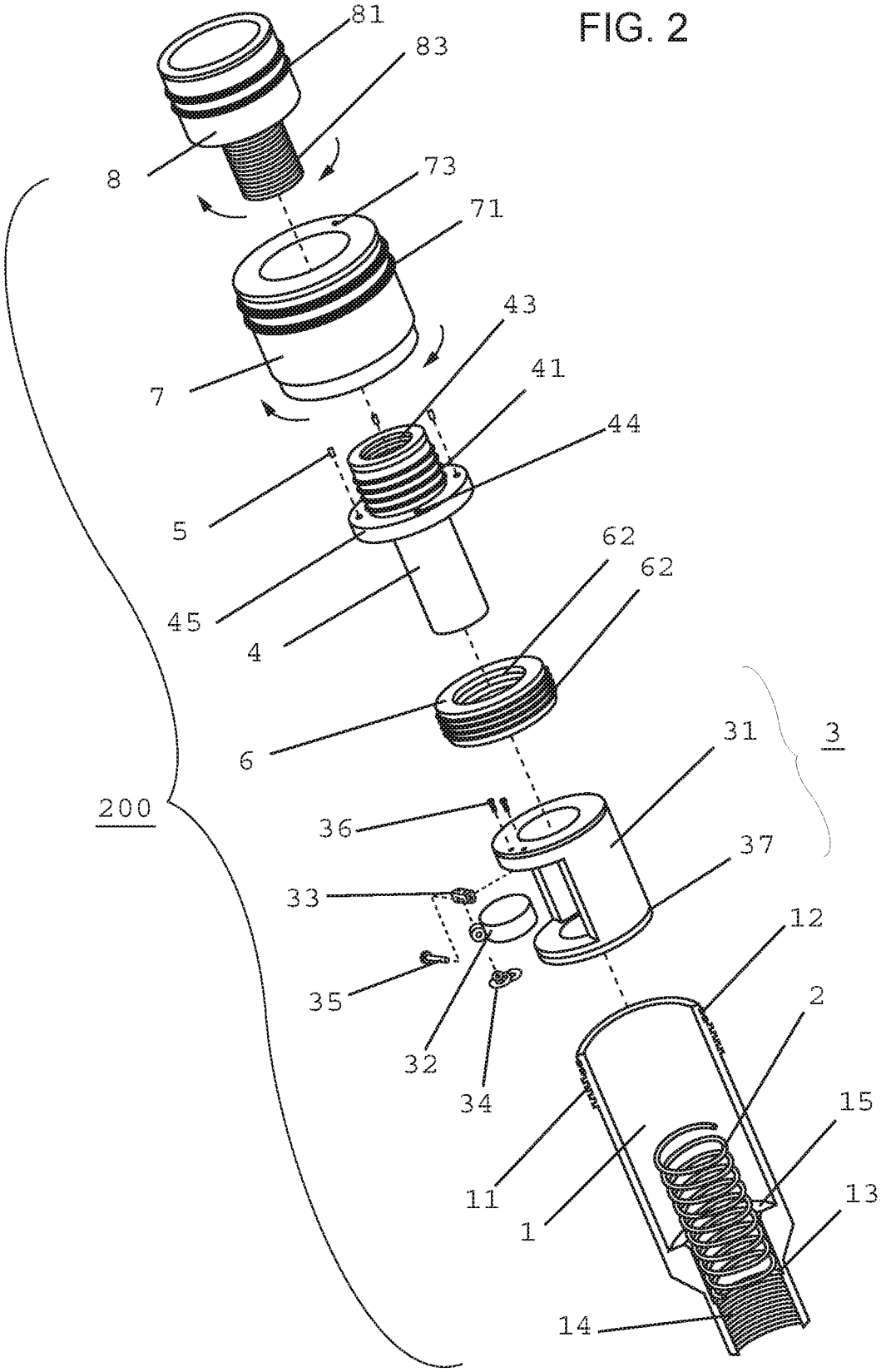
FIG. 2 is an exploded view of the components of one embodiment of the present invention. The lower body is shown in cross-section.
Figure 6:
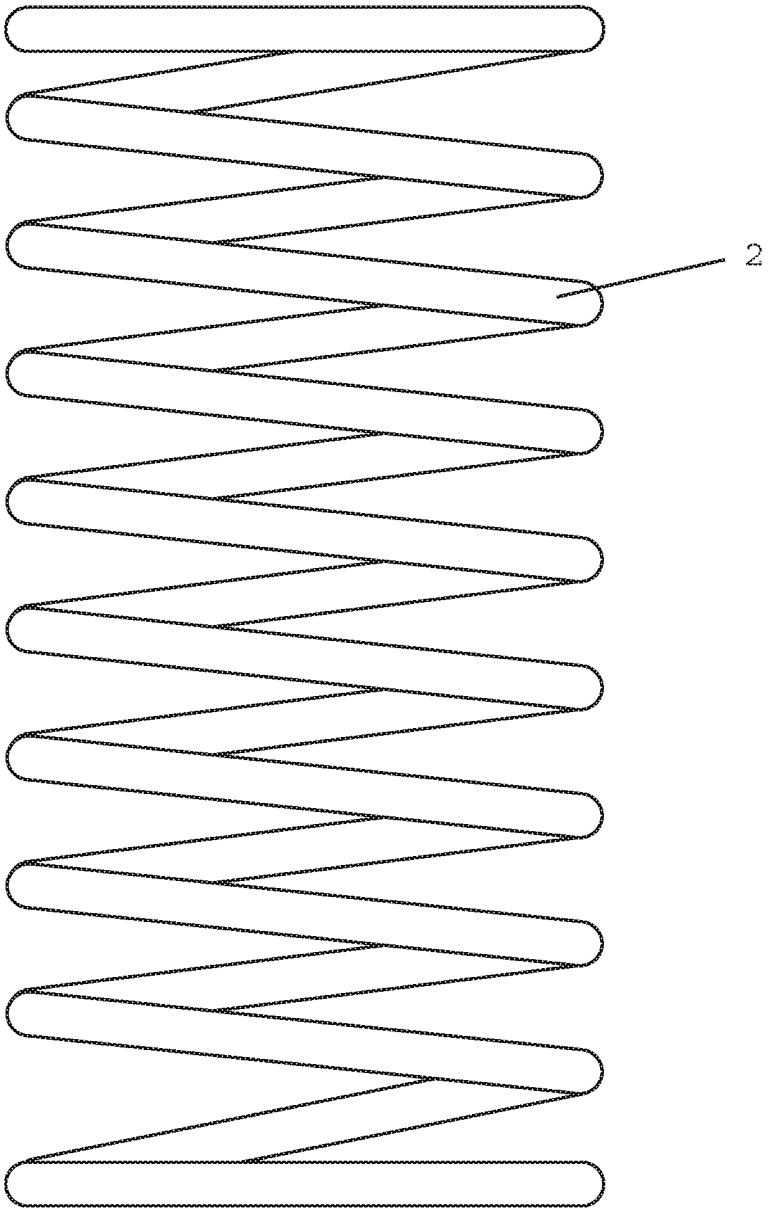
FIG. 6 is an elevation view of the coil spring.

The exploded view of FIG. 2 provides an educational illustration of the components of one embodiment of the present invention. Most of the components are shown in perspective view and the lower body 1 is also shown in cross-section to reveal the coil spring 2, the lower body shoulder 13, the production tubing threads 14, and the gate housing seat 15. The fastening means of lower body threads 11 and the lower body seals 12 are also demonstrated. The lower body 1 is annular in shape with a bore of descending diameter extending therethrough. Prior to assembly, each component is dressed with the proper seals. The coil spring 2 (shown in isolation in FIG. 6) is installed in the lower body 1 and should rest on the lower body shoulder 13 above the production tubing threads 14. The lower end of the invention, particularly the lower body 1 is adapted for suspending a tubing string 101 (see FIG. 1) and may take on various features to accommodate tubing string fasteners.

Figure 7:
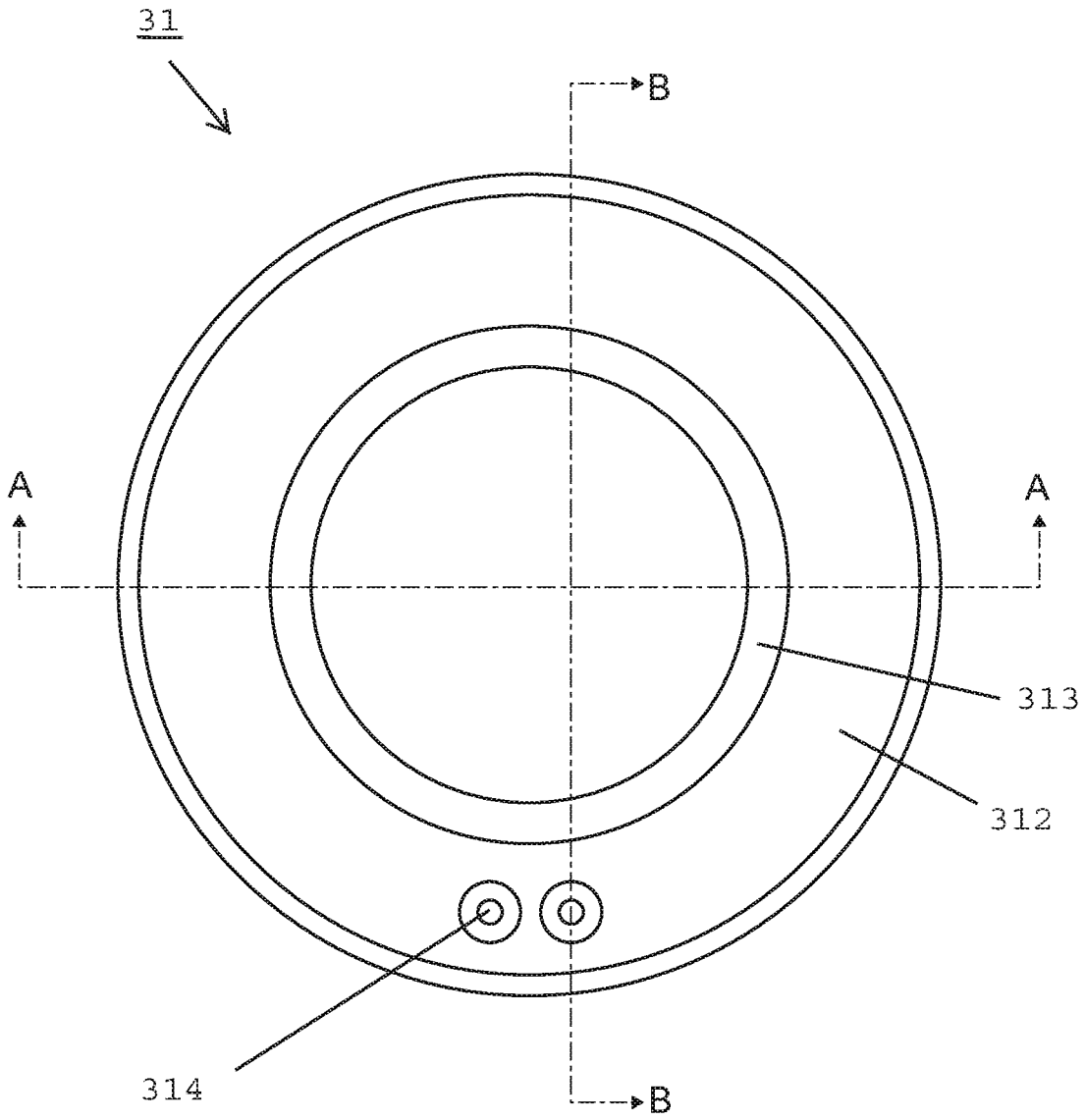
FIG. 7 is a top view of the gate housing.
Figure 8:
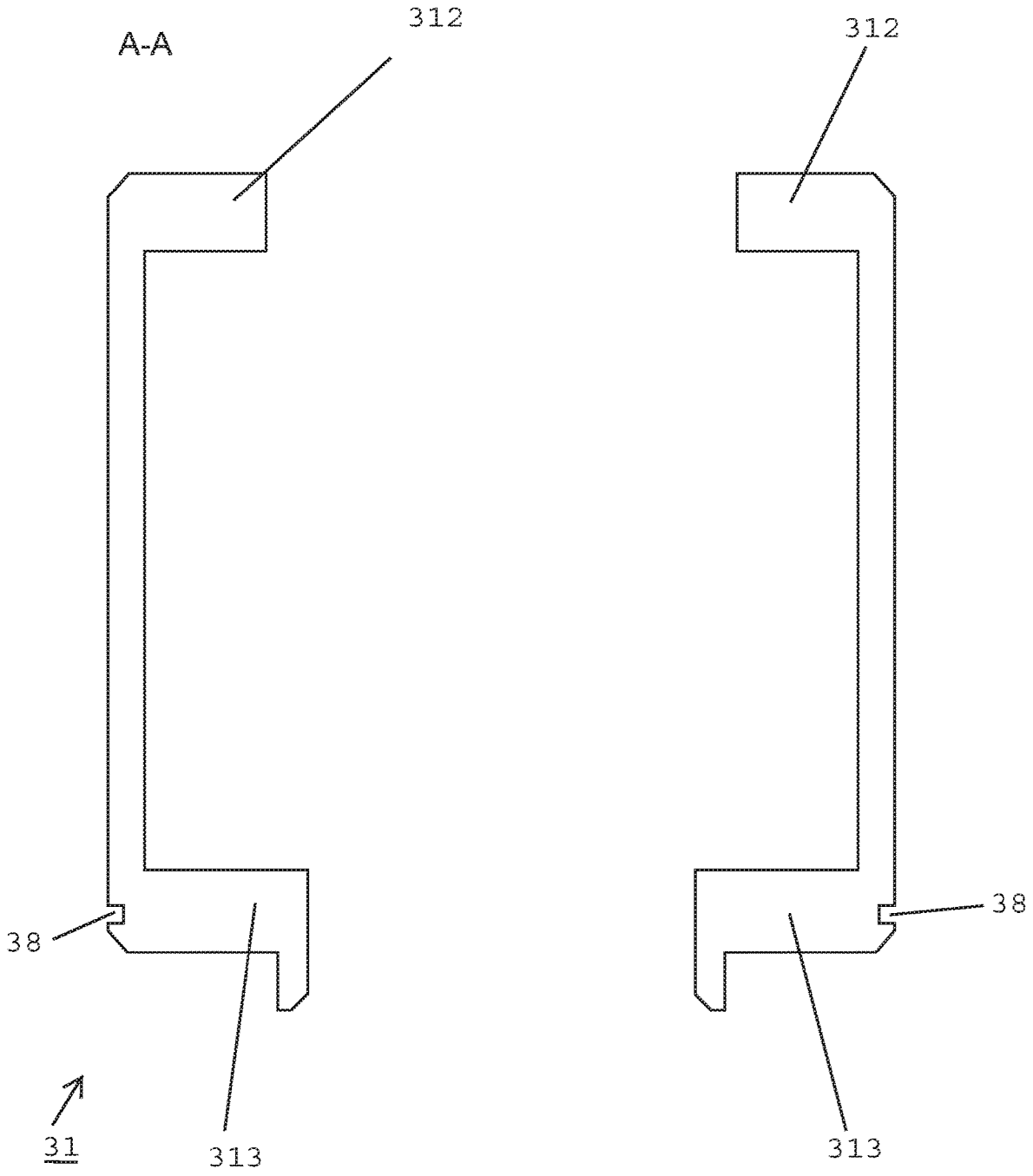
FIG. 8 is a cross-sectional view of the gate housing from line A-A in FIG. 7.
Figure 9:
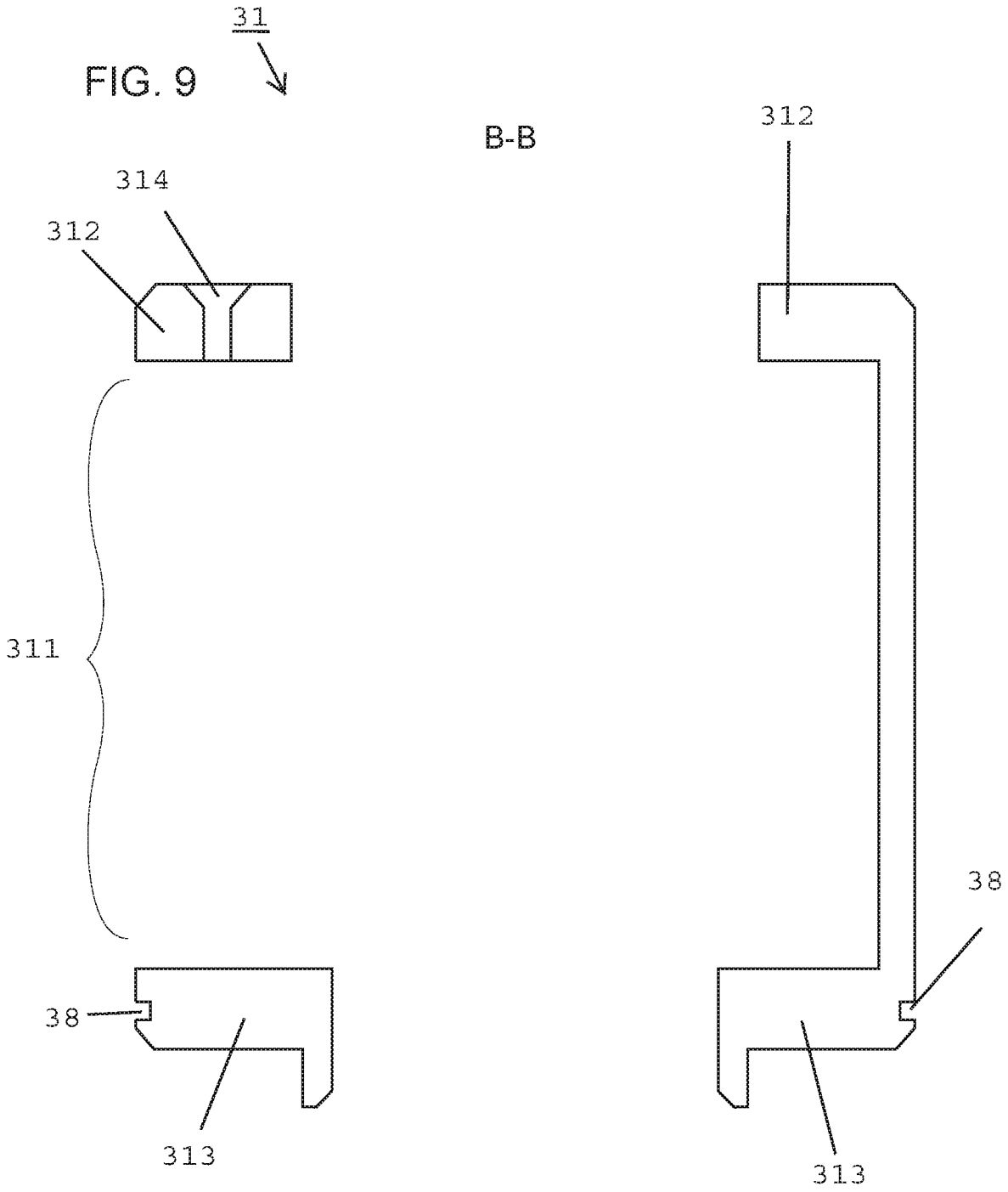
FIG. 9 is a cross-sectional view of the gate housing from line B-B in FIG. 7.
Figure 10:
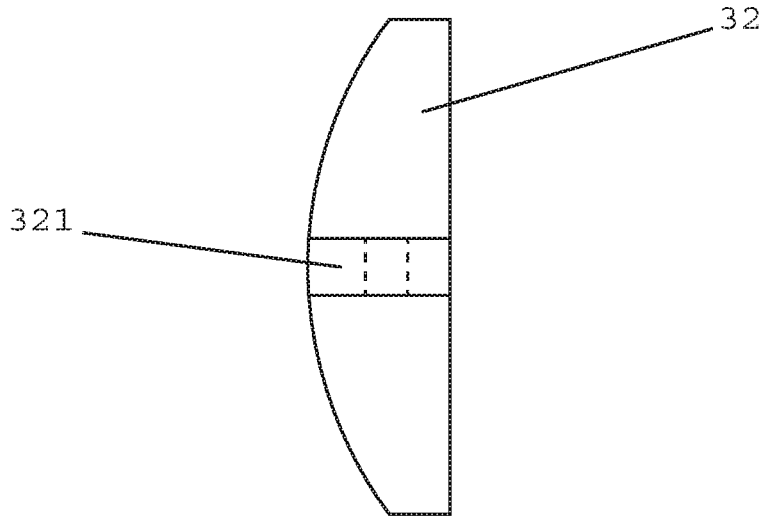
FIG. 10 is a top view of the gate when in an open position.
Figure 11:
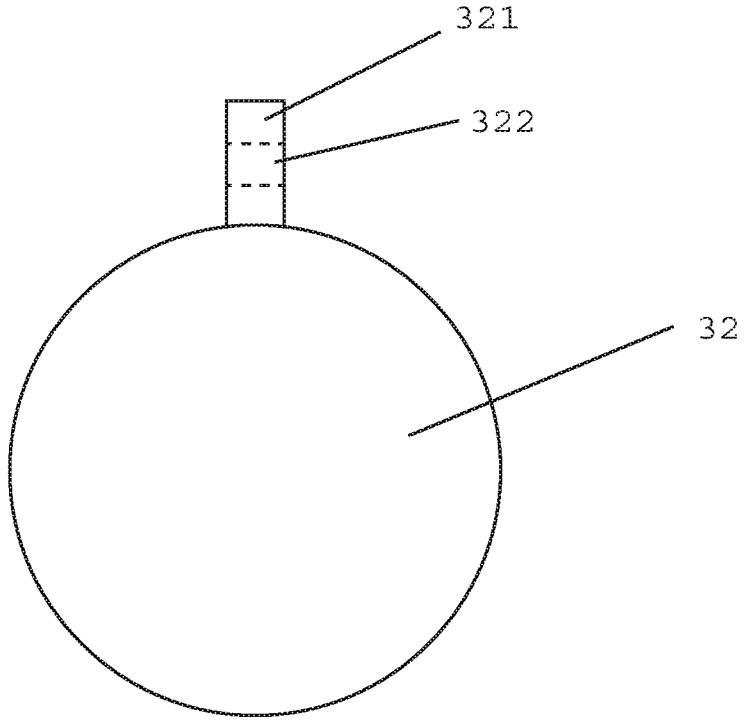
FIG. 11 is a top view of the gate when in a closed position.
Figure 12:
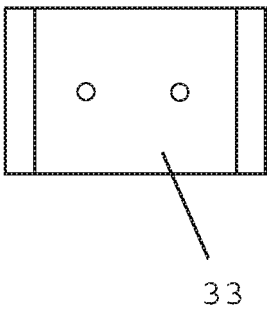
FIG. 12 is a bottom view of the gate bracket.
Figure 13:
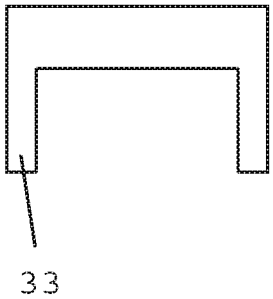
FIG. 13 is a side view of the gate bracket.
Figure 14:
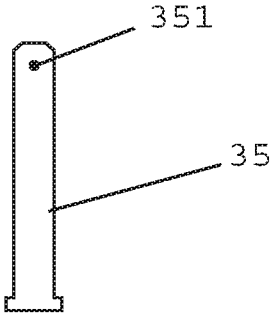
FIG. 14 is a plan view of the gate pin.
Figure 15:
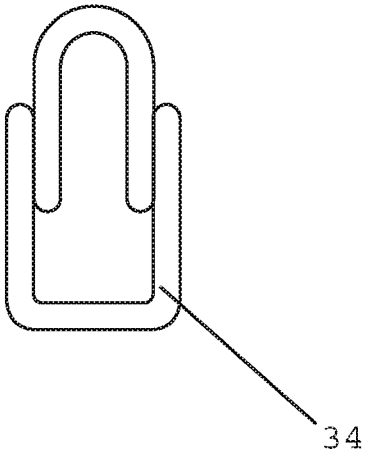
FIG. 15 is a bottom view of the gate spring.
Figure 16:
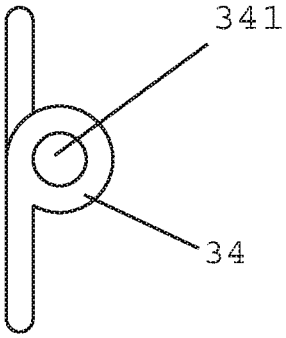
FIG. 16 is a side view of the gate spring
Figure 17:
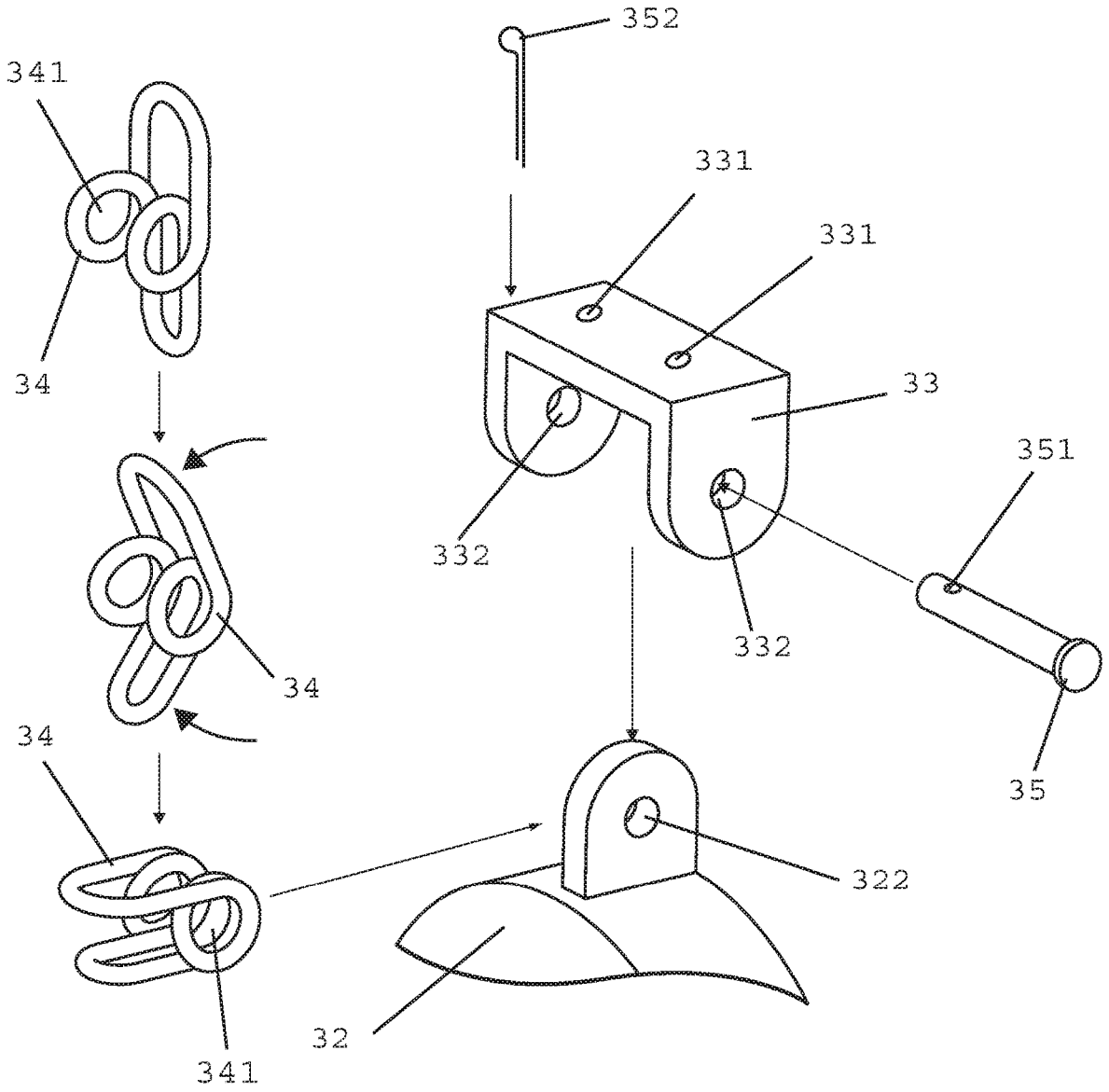
FIG. 17 is a perspective, action view showing the assembly of the gate, gate spring and gate bracket.

The next component shown in the exploded view of FIG. 2 is the gate assembly 3 which is assembled by first attaching the gate bracket 33 to the gate housing 31 by machine screws 36 through respective holes 314, 331. The gate housing 31 is also shown in isolation in FIGS. 7-9 to show the screw holes 314 that traverse the upper ledge 312 and the showing the void 311 of the gate housing wall which receives the gate 32 when the valve is in the open position. FIGS. 8-9 also show the gate seal notches 38 that receive the disk shaped, gate seal 37. The gate 32 is shown in FIG. 2 and then in more detail in the isolated views in FIGS. 10-11 and the action view of FIG. 17. The gate arm 321 has a hole 322 that will receive the gate pin 35. The gate bracket 33 can be more clearly seen in FIGS. 12-13 & 17. With reference to FIG. 17, the gate 32, more specifically the gate arm 321 and gate spring 34, are aligned with the gate bracket 33 and the gate pin 35 is inserted through the respective receiving holes 332, 341, 322 (see additional detail in FIGS. 10-17). The pin 35 is secured in place using a cotter pin 352 through the hole 351. FIG. 17 more clearly shows how the gate spring 34 is compressed prior to being installed in the gate assembly which will bias the gate 32 to the closed position.

Figure 4:
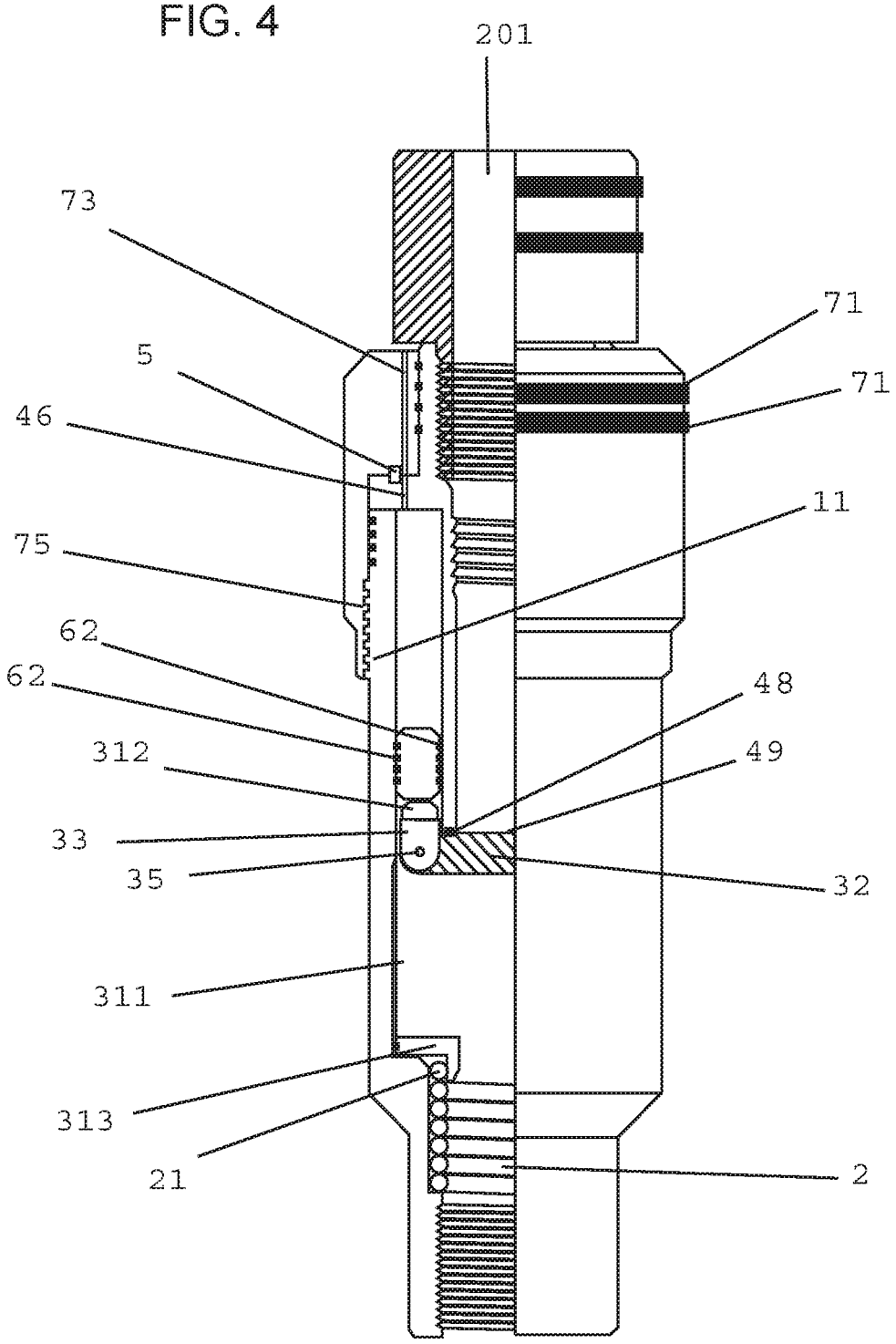
FIG. 4 is a cut away view of one embodiment of the invention installed in the tubing head beneath a wellhead production tree. The valve is in the closed position when the pressure from the well is sealed below the valve.

The assembled gate assembly 3 is lowered into the lower body 1 and rests on the coil spring 2. When the coil spring 2 is compressed and the gate 32 is closed, the gate housing 31 will rest on the gate housing seat 15 of the lower body 1. The compressed coil spring 2 is illustrated in FIG. 4. The shape of the gate housing lower ledge 313 is formed to abut the coil spring-to-gate assembly interface 21. One side of the gate 32 is curved to match the shape of the lower body wall when in the opened position.

Figure 20:
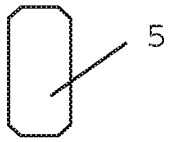
FIG. 20 is a plan view of the alignment pin.

With continuing reference to the exploded view in FIG. 2, the ring piston 6 seats atop the gate housing 31 and then the flow piece 4 is inserted through the ring piston 6 and gate housing 31 until the flow piece ledge 45 rests atop the ring piston 6. Alignment pins 5, also shown in FIG. 20, are used to coaxially hold the upper body 7 in-line with the flow piece 4. In the preferred embodiment four alignment pins 5 are used but at least one is all that is needed to provide the desired function to keep the flow piece from spinning relative to the upper body. While the alignment pins 5 hold the relationship between the upper body 7 and the flow piece 4, a fastening means joins the flow piece 4 with the hanger neck 8. In the preferred embodiment, hanger neck threading 83 mates with flow piece threading 43. Once all of the components have been coupled the upper body 7 threads onto the lower body 1. Alternative arrangements could include threading to fasten the hanger neck 8 to the upper body 7.

Figure 3:
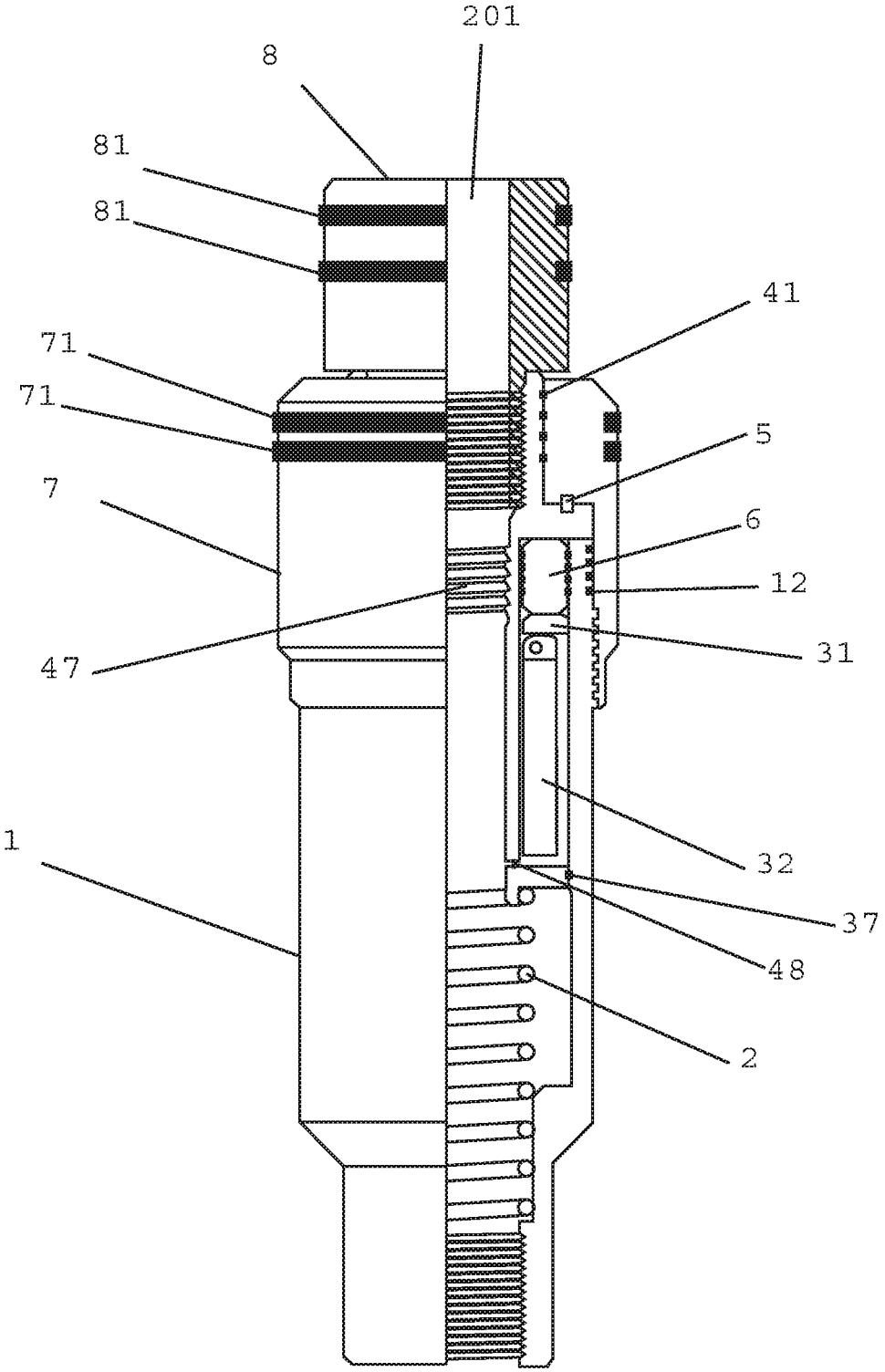
FIG. 3 a cut away view of the components of one embodiment of the present invention. The valve is in the open position when the well is operating.

The action of the various components shown in FIG. 2 is revealed in the cut-away views of FIGS. 3 and 4. FIG. 3 illustrates the partial cutaway elevation view of the preferred embodiment with the seal, in this case a gate 32, in the open position. The gate 32 is vertical within the gate housing 31 and the ring piston 6 is all the way up the shaft of the flow piece 4. FIG. 4 is another cutaway elevation view but this time the gate 32 is in the horizontal position closing the well production bore and sealing off any pressure from escaping through above the tubing head.

The closing of the control valve as illustrated in FIG. 4 is actuated by pressure introduced through the test port shown in FIG. 1. When the introduced pressure 91 into the void 106 and through the upper body vertical port passage 73 and the flow piece vertical port passage 46 is greater than the formation pressure 92 coming up through the production bore 101, the greater introduced pressure 91 will displace the ring piston 6 in a downward direction as is shown in FIG. 4. Since the valve's required operating pressure is contingent on the well pressure, it sometimes may operate with as little as 100 pounds per square inch (psi), and other times will be much, much higher. The movement of the piston 6 moves the gate housing 31 and thereby the gate assembly 3. The gate housing 31 moves relative to the stationary flow piece 4 which retains the gate 32 in a vertical position within the void 311 in the wall of the gate housing 31 when the gate is open as shown in FIG. 3. The movement of the gate housing 31 also compresses the coil spring 2 within the lower body 1 (see FIG. 4). When the pressure 91 has lowered the piston 6 and gate housing 31 down to the gate housing seat 15, the gate assembly 3 is once again stationary and the gate 32 has room to move within the gate housing 31. The articulating gate spring 34 of the gate assembly 3 shown in FIG. 17 will force the gate 32 into a horizontal position, meaning the gate spring 34 causes the gate 32 to articulate into a position that is perpendicular to the well production flow coming up through the well bore 101 and central bore 201 of the tubing head as shown FIG. 4. The gate spring 34 also biases the gate 32 to a default position which is perpendicular to the production flow. When production flow is vertical to the horizon then the gate 32 default will be horizontal to the horizon, and vice versa. When the gate 32 is in the default position it will engage with the lower annular opening 49 of the flow piece 4 and close the central bore 201 thereby cutting off the production flow above the gate 32 including from the tree or valves above the tubing hanger. The pressure that already accumulated above the seal can be slowly released by tree valves. The resulting pressure differential created between the formation pressure 92 below the gate 32 and the lack of pressure above the gate 32 causes the gate to remain in place—in the default, closed position. The objectives for cutting off the well bore production tubing flow from the tubing hanger can be completed.

Once the seal is complete, the applied pressure 91 in the void is released back through the test port 108. Unlike other valves that require two ports, one to open them and one to close them, the present invention utilizes the single test port to apply and release pressure via the tubing head void space. The well pressure 92 once again being greater than any applied pressure in the void causes the free ring piston 6 to return to its upward position. Thus, when the valve is closed there is no pressure above the gate 32 and well pressure 92 (e.g., 500 psi) below the gate. After the well tree access objectives are met and production flow is once again desired, tree pressure 93 is introduced down the central bore 201 through the upper valves of the tree assembly in an amount equal to the well flow pressure 92 pushing up from the formation. For example, 500 psi would be applied to the upper surface of the gate to equal the example of 500 psi flow coming up the well bore. This downward introduced pressure 93 causes the pressures to equalize above and below the gate. In this neutralized pressure zone, the coil spring 2 in the lower body 1 will push the gate assembly 3 back up against the ring piston 6 and flow piece 4. The shaft of the flow piece 4 will return the gate 32 back into a vertical position.

Figure 21:
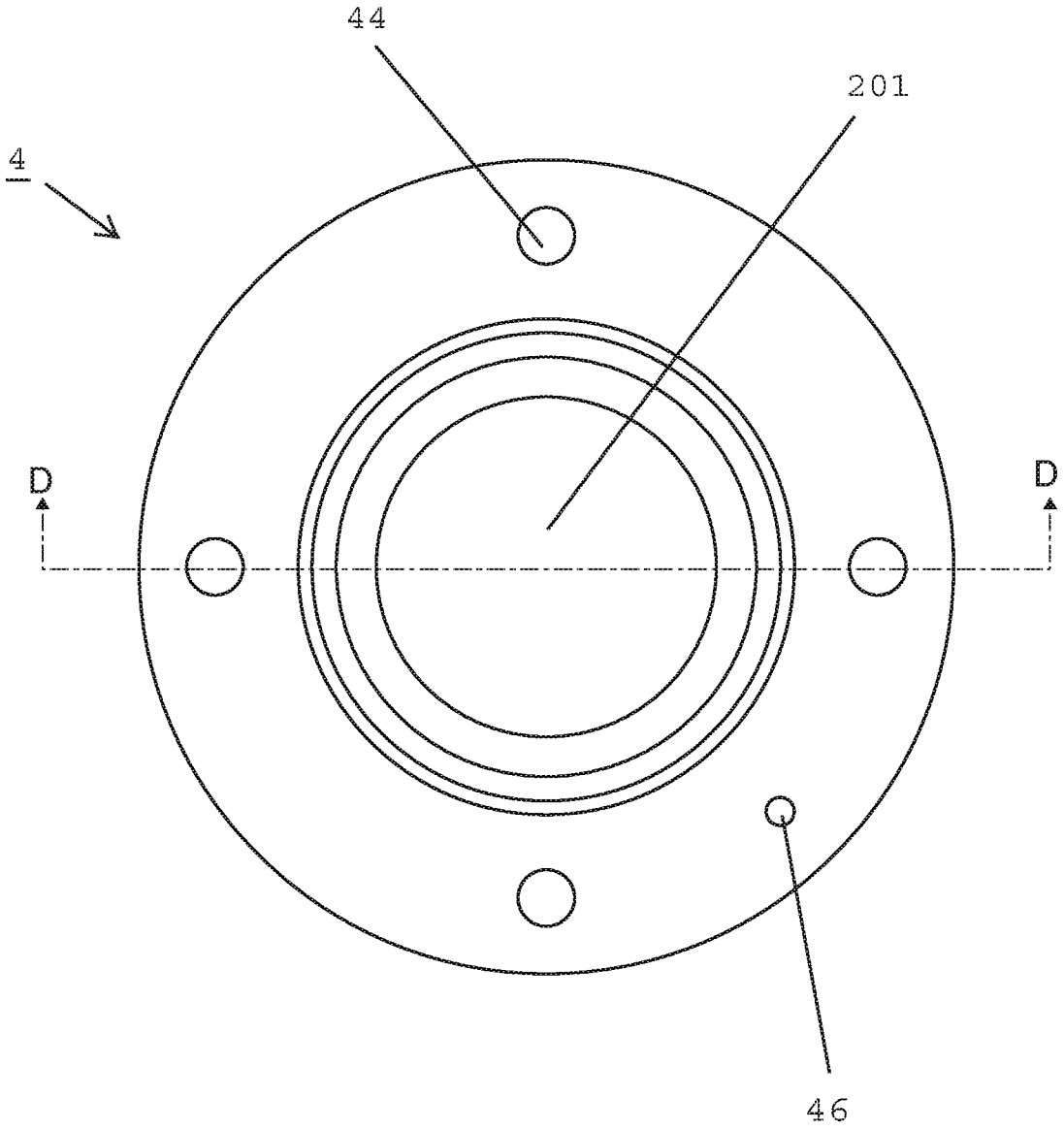
FIG. 21 is a top view of the flow piece.
Figure 22:
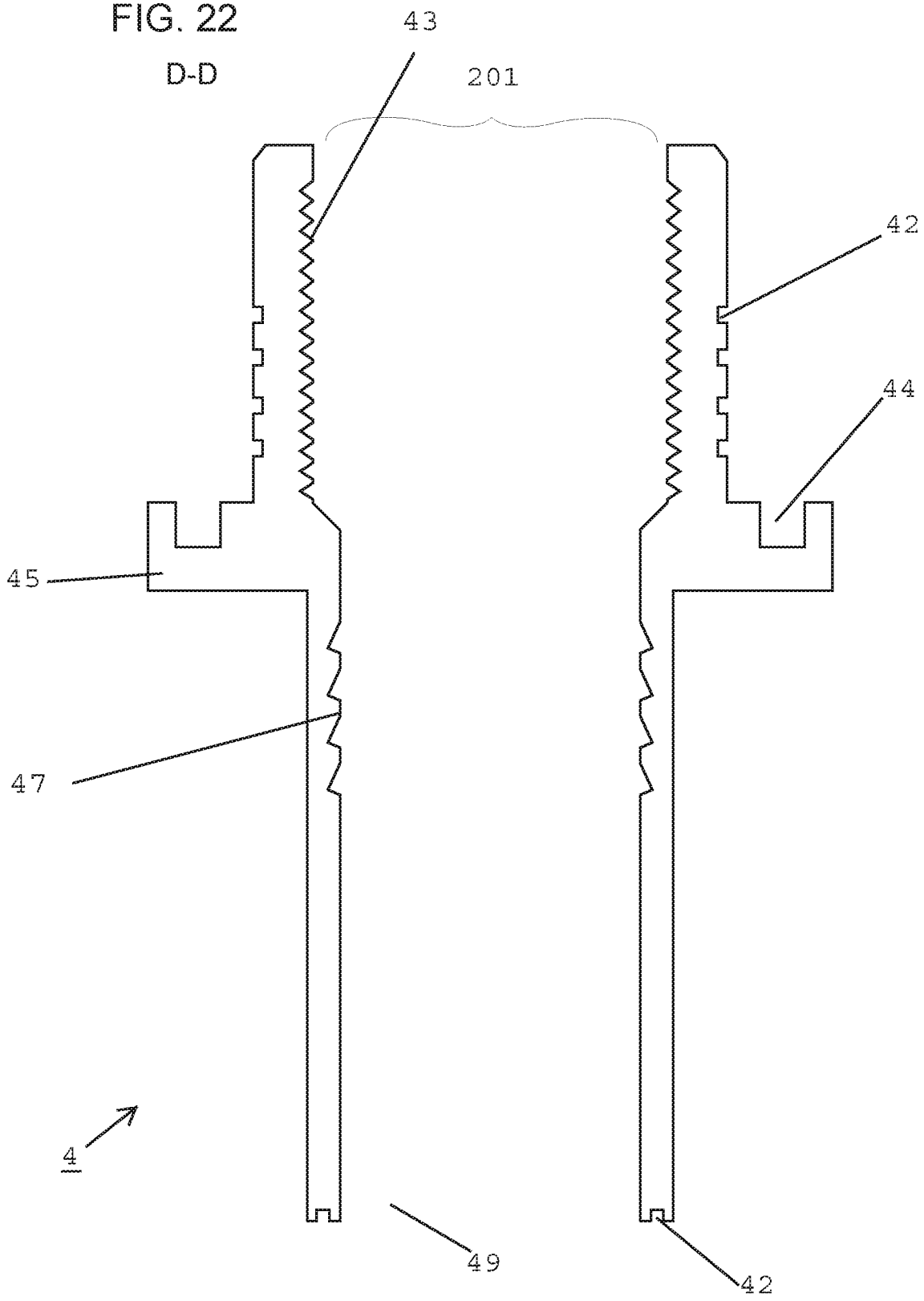
FIG. 22 is a cross-sectional view of the flow piece taken from line D-D in FIG. 21.

With reference to FIGS. 2, 21 & 22, the flow piece 4 comprises flow piece seals 41, flow seal notches 42, flow piece port hole or passage 46 for vertical port or pressure transfer, alignment holes 44, a ledge for alignment holes 45, and threading 43. As with the other components, the flow piece 4 includes a central bore 201. In the preferred embodiment, the gate 32 seals the flow piece lower annular opening 49 that is on the lower end more proximal to the formation and thereby seals the central bore 201. Surrounding the flow piece annular opening 49 is another seal 48, which helps seal the gate 32 during well closure but when the gate 32 is open the seal 48 will interface with the gate housing lower ledge 313 to prevent sand or other particles from getting into the valve.

Figure 23:
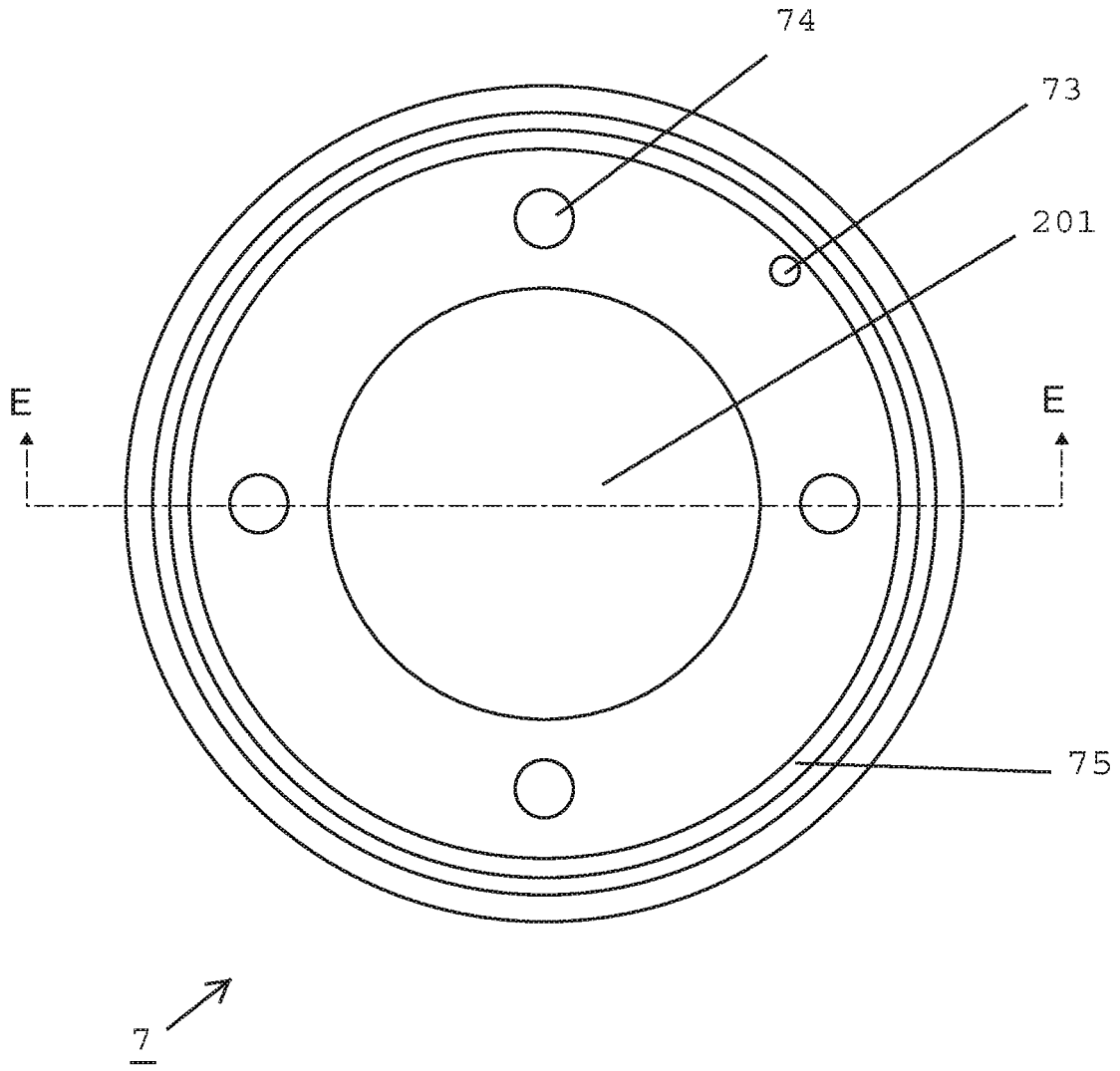
FIG. 23 is a bottom view of the upper body.
Figure 24:
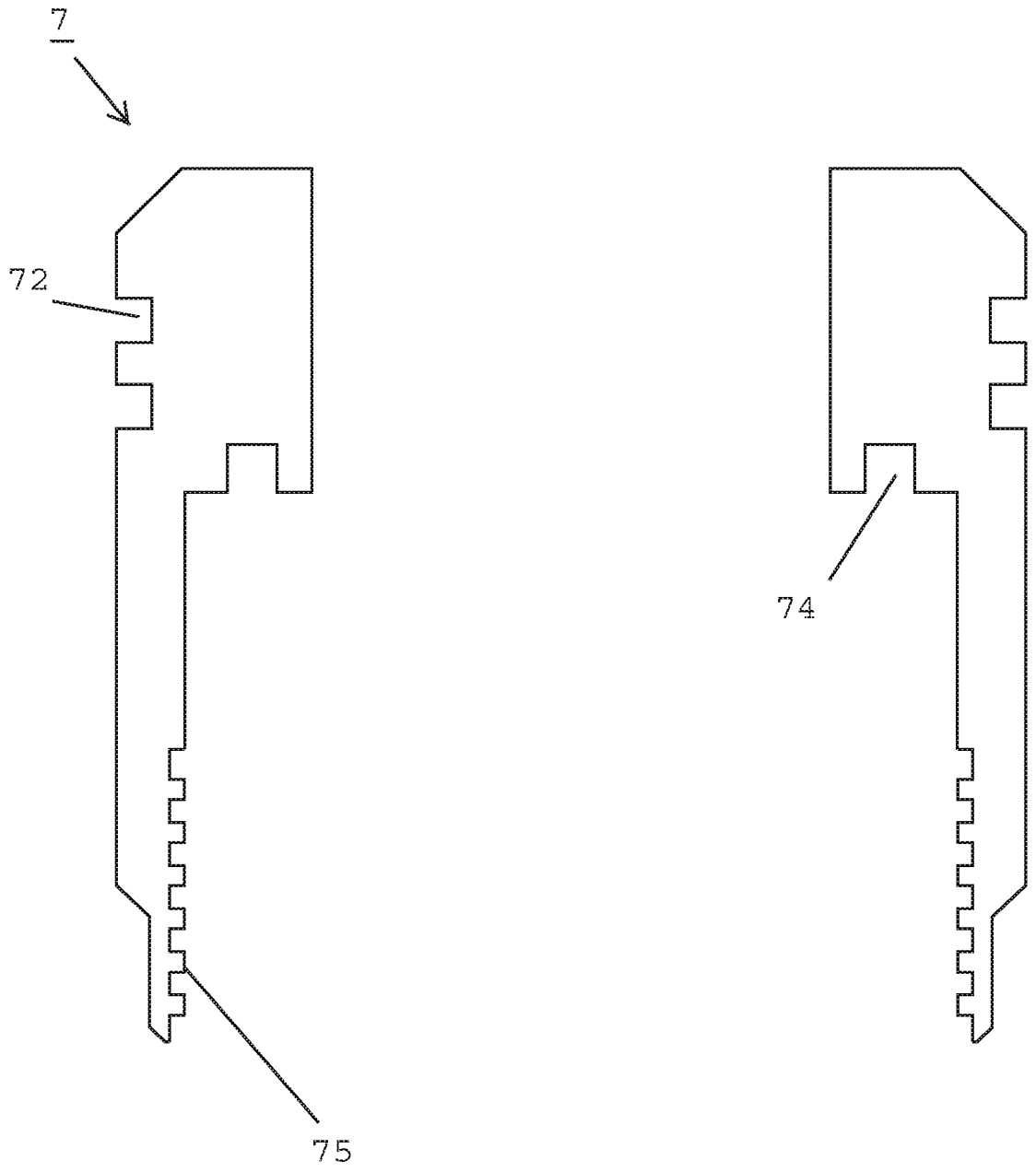
FIG. 24 is a cross-sectional view of the upper body taken from line E-E in FIG. 23.

FIG. 23 presents a bottom view of the upper body 7 and also demonstrates the central bore 201 common to all of the invention components. The upper body hole or passage 73 for vertical port or pressure transfer and the alignment holes 74 are also visible in this bottom view. The upper body 7 is shown in isolated cross section in FIG. 24 which illustrates the seal receiving notches 72 and threading 75. The upper body 7 is coupled between the hanger neck 8 and the flow piece 4 (see FIGS. 2-4). In some embodiments, an existing hanger neck may be employed (see FIG. 5). Similarly, the hanger neck 8 and the upper body 7 may be eliminated from some embodiments of the present invention and the remaining components sold for aftermarket coupling with those existing, wellhead structures. In the preferred embodiment, complementary threading 83 of the hanger neck 8 is received by threading 43 of the flow piece 4. The upper body is held between the hanger neck 8 and flow piece 4 with alignment pins 5 (see FIG. 2). Whether supplied with unique components according to the present invention or as already in place in the tubing head adapter, the upper body seals 71 seal in the top of the tubing head 103 and thereby isolate the annulus 102 of the well as shown in FIG. 1.

Figure 5:
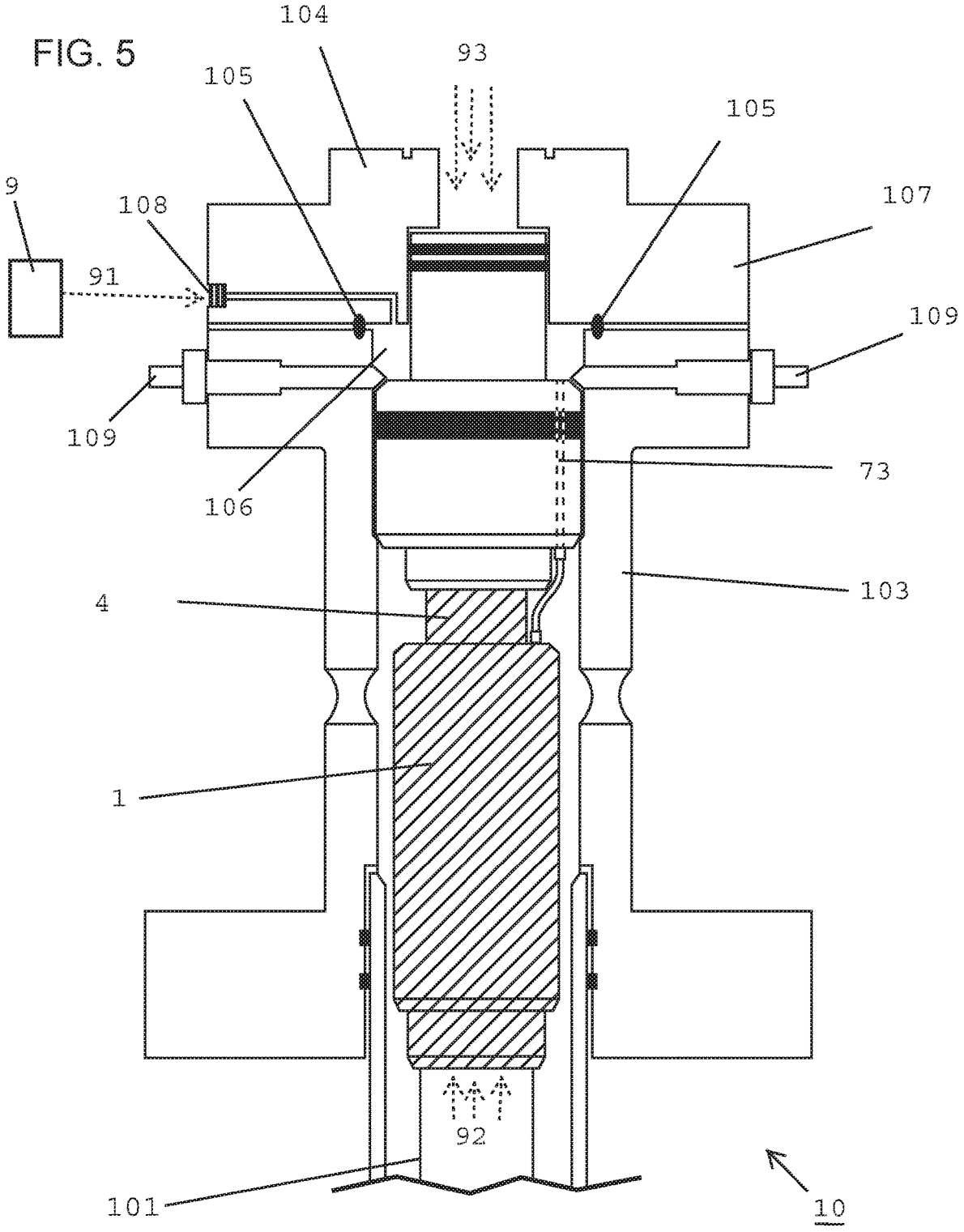
FIG. 5 is an elevation view of an alternative embodiment of the invention installed in the tubing head beneath a wellhead production tree.
Figure 25:
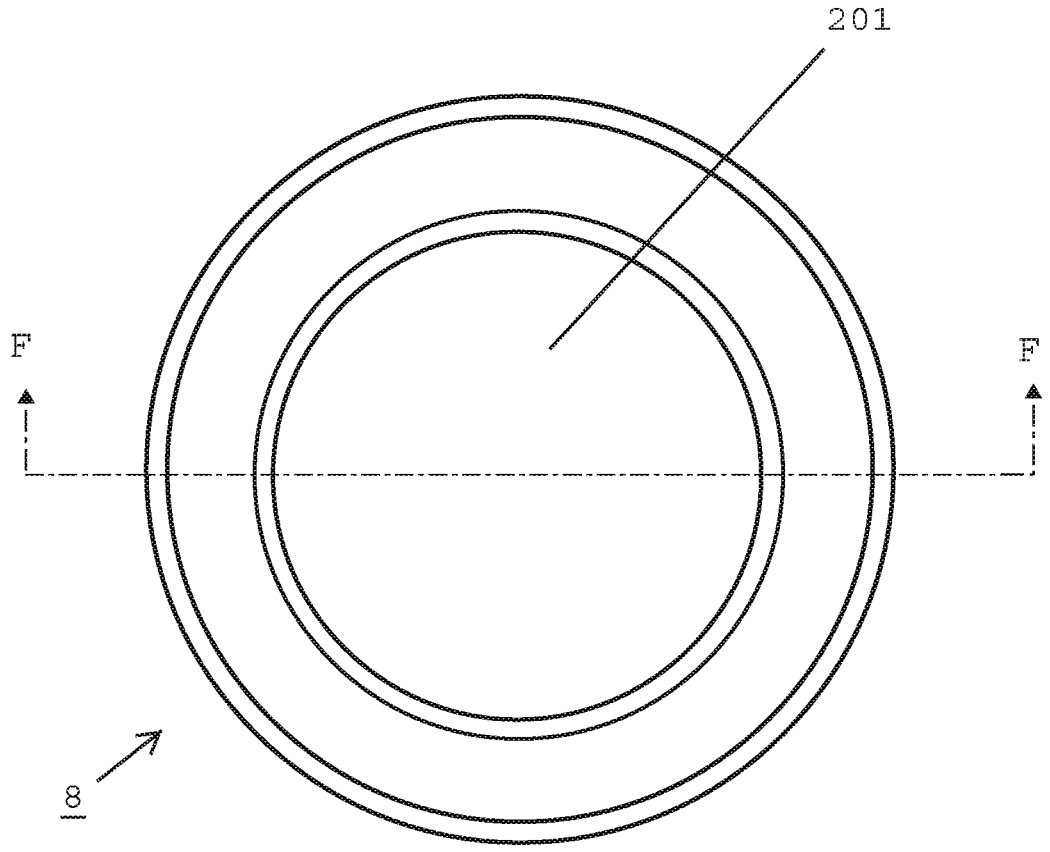
FIG. 25 is a top view of the hanger neck.
Figure 26:
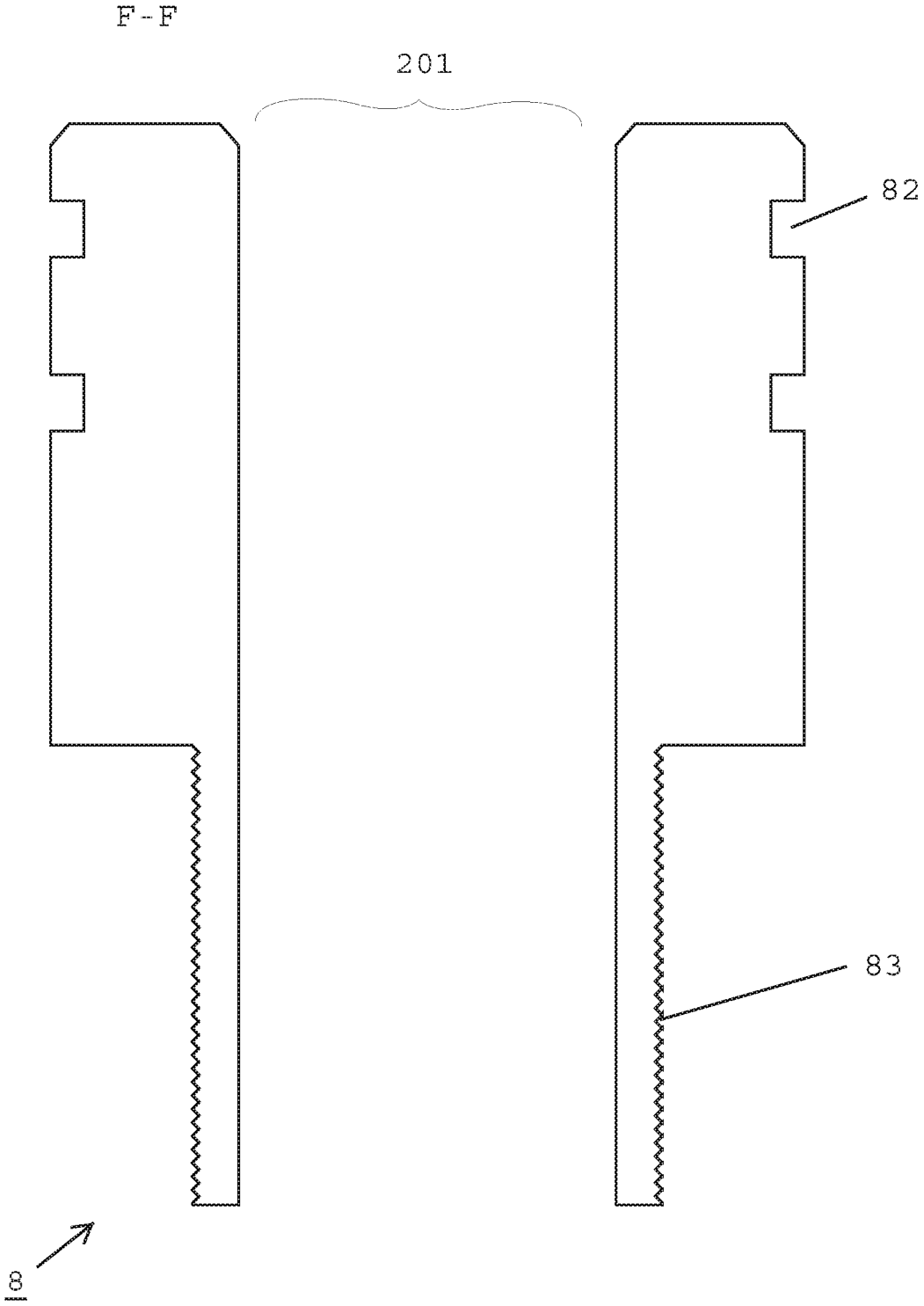
FIG. 26 is a cross-sectional view of the hanger neck taken from line F-F in FIG. 25.

The hanger neck 8 is shown in isolated top view in FIG. 25 and in isolated cross section in FIG. 26. The central bore 201 is visible again in FIG. 25 and FIG. 26 and shows the seal notches 82 that will retain the seals 81 to create one of the three sealing points for the void space 106. The hanger neck 8 protrudes from the top of the tubing head 103 into the tubing head adapter 104 as shown in FIG. 1. As stated above, the hanger neck 8 is optionally eliminated from some embodiments of the improved tubing hanger as shown in FIG. 5. In that case, the tubing head seal or seals of the existing tubing hanger interface with the tubing head adapter 104 and isolate the bore pressure as is normally the case. The normal sealing connection between the tubing hanger hydraulic fluid passage and the tubing head member hydraulic fluid passage is accomplished by two circumferential annular seals that surround the tubing hanger below and above the void space. The remaining control valve 200 components would be introduced to improve the existing tubing hanger. In this retrofit style embodiment, a lower body 1 is formed to fixedly join with the existing hanger and contain the operating portions of the control valve 200 including the transfer component, the workpieces, and the seal.

The valve assembly components of the preferred embodiment including the Hanger Neck 8, Upper Body 7, Lower Body 1, Alignment Pins 5, Flow Piece 4, Ring Piston 6, Coil Spring 2, Gate housing 31, Gate 32, Gate bracket 33, Gate spring 34, and Gate pin 35 are preferably made of steel. Some components may also be formed of stainless steel or aluminum. All of the steel components are custom made in a machine shop according to engineering drawings. The components will each be accompanied by seals. All of the sealing and O-ring components are industry standard and readily available for construction and replacement.

As shown in FIGS. 1 and 5, this control valve is located in or immediately below the tubing hanger and is hydraulically-actuated through the existing test port 108, thus adding a secondary functionality to the test port 108. When closed, the control valve provides a barrier to pressurized hydrocarbons, both liquid and gas, produced by the well thereby creating a safe working environment for the servicing of the wellhead. The claimed invention differs from what currently exists. The alternatives for well control (e.g., kill the well with heavy fluid, set a down-hole bridge plug, or use a lubricator to set a back-pressure valve at the surface) are more expensive and dangerous. Although all three present options of a kill fluid, wireline, or a surface plug set with a lubricator will maintain well control, they only do so with the attendant disadvantages mentioned above.

The present invention is an improvement on current industry practices. It safely isolates the well pressure at the surface, and could be used in conjunction with a back-pressure valve without utilizing a lubricator. After the gate 32 is closed setting a plug in the back-pressure valve threading 47 becomes quite easy and much safer. A dry rod can be used to set a plug when there is no pressure escaping from the well as will be the case when the test port activated tubing hanger control valve is closed. This new and innovative method of utilizing hydraulic test pressure in the tubing head adapter void space to actuate an in-line wellhead valve is safer, more efficient, and less expensive than current industry practices. The present invention eliminates the need for a lubricator and expensive specialized equipment. The valve fits inside the tubing hanger, and is easily operated by a standard hydraulic hand pump through the existing test port of the tubing head adapter. It is designed to be kept in-place and reused throughout the life of the well.

The present invention may be implemented by the provision of an improved tubing hanger or could in some designs be retrofit for installation beneath the tubing hanger. The adapted tubing hanger is placed in the tubing head of an oil or gas producing well by industry conventions of fitting and sealing. A hydraulic hand pump 9 is attached to the test port 108 of the tubing head adapter 104. The pumping of the hydraulic hand pump 9 creates pressure, commonly up to 10,000 psi, which may far exceed the pressure required to overcome the well formation pressure 92 and actuate the sealing mechanism. As pressure is created in the pump 9 it is transferred into the tubing head adapter void space 106 then down through the upper body hydraulic vertical passage 73 (as shown in the embodiment of FIG. 5) and flow piece port or passage 46 (see FIG. 4) and the pressure displaces the transfer component, such as the ring piston 6, downward (see FIG. 4). The interference of the wall of the transfer component 6 with the wall of the seal housing causes the movement of the seal assembly 3. With the movement of the seal housing 31 the seal engagement components are actuated. The seal 32 pivots or swings from a vertical position (open) to a horizontal position (closed). A coil spring 2 in the lower portion 1 of the tubing hanger prevents the seal assembly 3 from depressing too far. The structural support of the seal housing 31 and the flow piece 4 abut the horizontal seal 32 to provide additional security. With the seal 32 firmly in place, the wellhead valves above the tubing head are opened in order to release the trapped pressure in the tree.

In short, the seal of the present invention is moved into place by the application of external pressure 91 through a port 108 existing for a starkly different purpose than that of the present invention. The conversion of this single-use port into a multi-use port is a huge advantage in the industry where every new mechanism introduces a new point of maintenance or potential failure. Given the scale of the machinery and the magnitudes of pressure involved many mechanical failures put lives at risk.

An alternative embodiment has analogous features to the preferred embodiment but as pressure is created in the tubing head adapter void space an actuating plunger with gears moves downward. In this embodiment gears on the actuating plunger engage the gears on the seal housing causing the seal housing to pivot on the gear pin swinging it from a vertical position (open) to a horizontal position (closed). The lip on the actuating plunger prevents it from depressing too far. At this point the wellhead valves above the tubing head are opened in order to release the trapped pressure in the tree. The pressure differential above and below the seal body will cause the seal body to lift into the sealing surface in the tubing hanger body, thus sealing the valve closed, isolating the pressure below, and providing safe working conditions on all wellhead components above the valve.

In this alternative embodiment, an actuating plunger is fitted with four plunger O-rings and inserted into a 0.75 inch diameter hole in the tubing hanger body. Lower gears of the actuating plunger engage gears on a seal housing. In this embodiment, the seal housing pivots on a gear pin and the seal includes a t-spring attached to a seal body such as by a seal body screw. The seal body is fitted with a body seal and inserted into the seal housing. An upper hanger seal is fitted to a five-inch upper neck of the tubing hanger body. The lower hanger seal is fitted to the lower section of the tubing hanger body. The lower section has an outer diameter of seven inches and a fastening means by which to couple with the production line 101 and a central bore 201 which permits flow to continue from the production line.

In the preferred embodiment, the improved cylindrical tubing hanger has a diameter between four and seven inches. The upper body 7 may be larger in diameter than the hanger neck 8 diameter. The lower body 1 will typically have a smaller diameter than the upper body 7. The total length of the preferred embodiment of the improved hanger is approximately eighteen (18) to twenty-four (24) inches. As one fastening example, the hanger may have 2 and ⅞ inch EUE threads on top and 4.5 inch LTC threads on bottom. Below the top EUE threads are 2.5-inch type-HBPV threads and below the HBPV threads is the valve sealing surface (having an outer diameter of 3 inches) and below that is the seal cavity (with an outer diameter of about 5 inches and about 4 inches in height). Any fastening or threading suitable to the function of the respective components will be useful particularly in order to join with existing parts such as the tubing string. The lower body seal 12 on the lower body is about 1 inch wide rubber that is ½-inch-thick with an outer diameter of about 7 inches. The upper body seal 71 on the upper body is about ½-inch-thick rubber with an outer diameter of about 5 inches.

Figure 18:
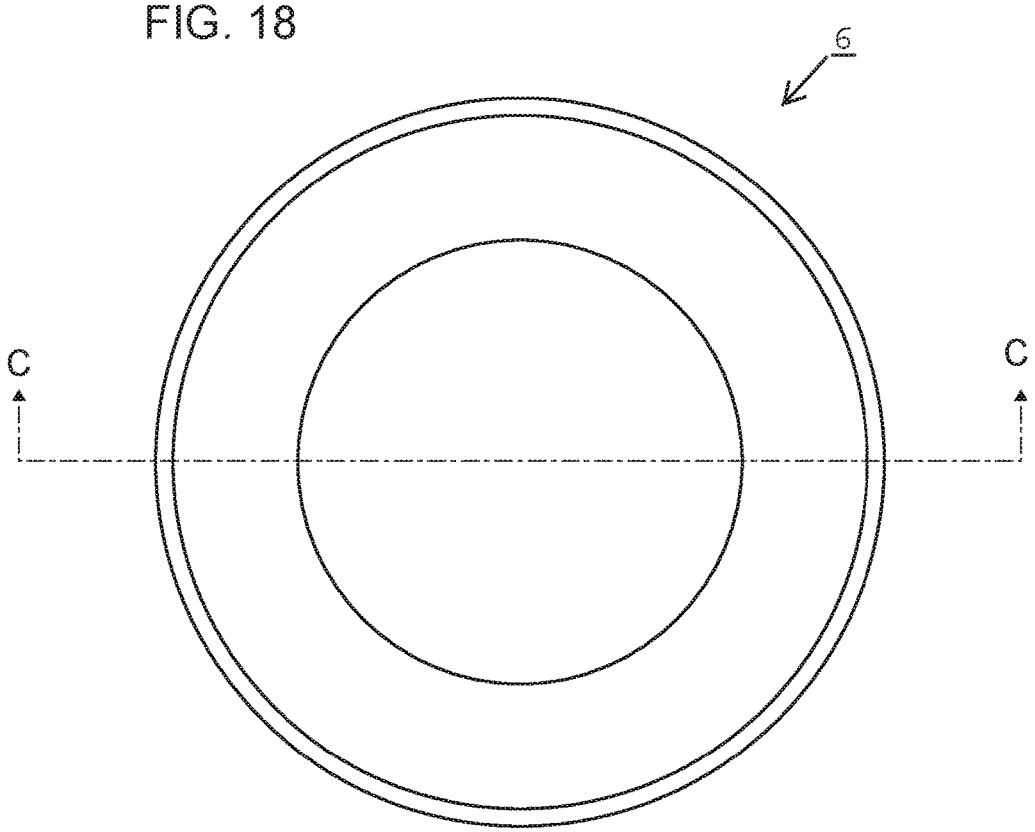
FIG. 18 is a top view of the ring piston.
Figure 19:
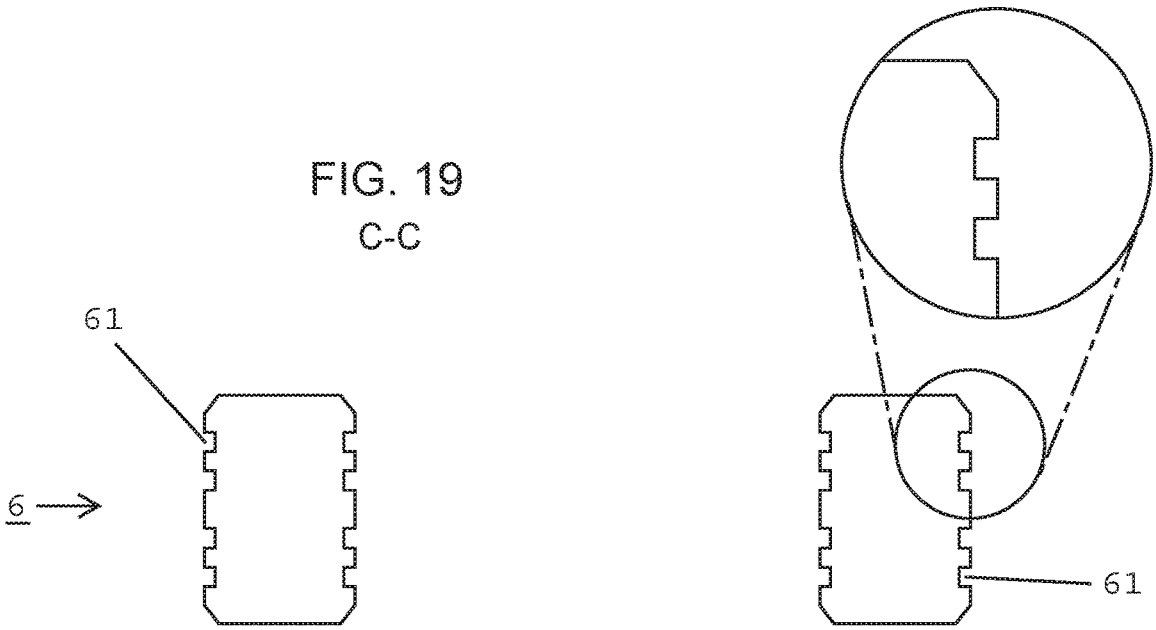
FIG. 19 is a cross-sectional view of the ring piston taken from line C-C in FIG. 18 with an enlarged view of seal receiving notches.

The ring piston 6 of the preferred embodiment is doughnut shaped with an inner diameter of about 3 inches and an outer diameter of about 5 inches and a height of about 1.5 inches. See FIG. 18. The ring piston seals 62 surrounding the outer diameter of the piston 6 have a similar diameter and fit into the teeth like structures called the ring piston seal notches 61 best visible in FIGS. 2 and 19. The flow piece 4 has an elongated cylindrical body about 9.25 inches in length with an inner diameter of about 3 inches. The flow piece ledge 45 has an outer diameter of approximately 5 inches. The gate housing 31 has an outer diameter of approximately 5 inches. The coil spring 2 has a resting height of approximately 7.5 inches and has an internal diameter of approximately 3 inches. Each component has an inner diameter sufficient to cooperate with the well production tubing string and accommodate the well output when the valve is open. In the preferred embodiment, the diameter of the central bore 201 is approximately 3 inches. In this case, the outer diameter of the gate 32 is 3 inches.

The seals used in the present invention are conventionally and readily available in the industry. In the preferred embodiment, the following seals will be implemented: Hanger Neck seals 81 (2) 0.375×5.00 S-Seal; Upper Body seals 71 (2) 0.375×7.06 S-Seal; Lower Body seals 12—(4) 0.25×6.05 O-Ring; Ring Piston seals 62 (4) 0.125×3.2 O-Ring; and Flow Piece seals 41—(4) 0.125×4.05 O-Ring.

In one alternative embodiment described herein the sizing and shape of the exterior components of the hanger is similar with workpiece components having unique characteristics. A 0.75 inch hole is bored for the hydraulically actuating plunger. The hydraulically actuating plunger has gears and a stop lip approximately 0.75 inch in diameter, 4 inches long. The seal housing is doughnut shaped at the bottom with gears having a height of about 1 inch and an outer diameter of about 3 inches and an inner diameter of about 2.8 inches. The seal body height is about ⅞ inch with an outer diameter of 2.75 inches, a perimeter groove about ⅜-inch-wide and 1/16 inch deep. The seal t-spring in this embodiment has two crossing flat springs about ¼-inch wide. The body seal is 1/16-inch-thick rubber, that is about ⅜-inch-wide with an outer diameter of about 2.75 inches. The four plunger O-rings are about ⅛-inch-thick with an outer diameter of about 0.75 inch. The seal body screw is a 1 inch long, number 6 machine screw and the gear pin is a ¼ inch in diameter and about 2 inches long.

When assembling the alternative embodiment described above, all of the steel components are custom but the rubber seals and O-ring components are industry-standard and readily available. The bore seal is installed onto the seal body. The seal body screw is used to attach the seal, such as by a t-spring, to the seal body. The seal body is inserted into the seal housing. The four plunger O-rings are installed onto the actuating plunger. The actuating plunger and O-rings are greased. The actuating plunger is installed, gear-side down, into the 0.75 inch hole of the tubing hanger body. The seal assembly is inserted into the seal cavity of the tubing hanger body, resting in the open position with the gears of the seal housing and the actuating plunger engaged. The gear holes of the seal housing and the actuating plunger are aligned, and the gear pin is installed. The upper and lower hanger seals are installed onto the outer diameter of the tubing hanger body.

The sealing elements may be formed by other engineering that will meet the required function of sealing the main production bore but must be actuated through the test port. The introduction of a dual functionality for the pressure test port on the tubing head adapter is novel and nonobvious in the oil and gas drilling industries. The hydraulic pressure generated by the hand pump both tests the integrity of tubing head adapter void space, and operates the valve.

The current configuration incorporates a valve into the body of a tubing hanger. An alternative configuration could be a separate valve that mounts in a separate valve body directly underneath the tubing hanger. Yet another embodiment actuates the valve with hydraulic pressure. This alternative embodiment is illustrated in FIG. 5. This modification would require a tubing such as an upper body passage 73 or vertical port to transfer hydraulic fluid from the tubing adapter void space 106 to the control valve 200. This modification would add versatility to the product. In this particular alternative embodiment design requiring liquid pressure, the control valve would be adapted to hang beneath any standard TC1A-EN hanger but would not require its own hanger neck. The proportions of the upper and lower bodies would be altered but the internal parts of the control valve would be unchanged. The standard hanger is modified by the addition of an upper body vertical port passage 73 of about 1/16 inch to 1/8 inch in diameter. Hydraulic pressure is transferred via the test port 108, through the void space 106 and through the upper body vertical port hole 73 to initiate the control valve workpieces. The access point to the void 106 would still be through the test port 108. Other embodiments operating with liquid pressure would be supplied with a complete improved tubing hanger such as those demonstrated in FIGS. 1-4. Likewise, some embodiments operating by air pressure may be retrofit adapted to be attached to an existing TC1A-EN tubing hanger neck and upper body.

Another modification could be to replace the gear mechanism between the actuating plunger and the seal housing with a fulcrum pivot mechanism. This would prevent fouling and malfunction of the gears. Another modification could be to the shape and sealing rubber component of the seal body.

Occasionally oil and gas companies need to or wish to replace or repair production trees, or install blow-out preventers, above the tubing hanger. This maintenance, removal or replacement of wellhead pressure control equipment is unsafe or impossible without closing the well to the atmosphere. The present invention allows the pressure within the well to be contained at the ground-level of the wellhead in a new, safe, inexpensive, repeatable and efficient manner. The new and innovative method of utilizing hydraulic test pressure in the tubing head void space to actuate an in-line valve is safer, more efficient and less expensive than the typical industry practices. The valve is located in or below the tubing hanger, and is easily operated by the delivery of hydraulic pressure with a standard hydraulic hand pump or some alternative means, through the existing test port of the tubing head adapter, or through any other access point.

The present invention adds a new and nonobvious functionality to the test port on the tubing head adapter that was previously never used for more than simply testing seals between the tubing head adapter 104 and the well head 10. With this new invention, the hydraulic pressure that is generated to test the tubing head adapter void space will also operate the control valve of the present invention. The pressure introduced through the test port will close the valve when the pressure introduced into the void space overcomes the well pressure. The control valve will open when the pressure above the valve equalizes with the well pressure thereby removing the pressure from the piston so that the coil spring forces the gate assembly upward and opens the gate.

In alternative embodiments, the introduced pressure 91 (see e.g., FIG. 1) could be applied through other passages such as through a modified version of the lock down screw 109.

It is further intended that any other embodiments of the present invention which result from any changes in application or method of use or operation, method of manufacture, shape, size, or material which are not specified within the detailed written description or illustrations contained herein yet are considered apparent or obvious to one skilled in the art are within the scope of the present invention.

We claim:

1. A method of sealing a well bore production tubing string at a well tubing head using a test-port pressure actuated sealing apparatus wherein the method comprises:

adding the test-port pressure actuated sealing apparatus to a tubing hanger, installing the tubing hanger in the well tubing head in-line with the well bore production tubing string to create a void space between the tubing hanger and the well tubing head, the well tubing head having a standard test-port, the standard test-port in fluid communication with the void space and the void space in fluid communication with the test-port pressure actuated sealing apparatus, applying an introduced pressure through the standard test-port, building the introduced pressure within the void space, overcoming well pressure pressing up from the well bore production tubing string with the introduced pressure applied through the standard test-port and transferred via fluid communication through the void space to the test-port pressure actuated sealing apparatus, and actuating the test-port pressure actuated sealing apparatus to seal the well bore production tubing string.

2. The method of claim 1 wherein the test-port pressure actuated sealing apparatus of the tubing hanger further comprises:

a body, a transfer component, an actuating mechanism, and a sealing valve, wherein the body houses the transfer component, the actuating mechanism, and the sealing valve.

3. The method of claim 2 wherein the body is in fluid communication with the standard test-port.

4. The method of claim 2 wherein the introduced pressure within the void space displaces the transfer component.

5. The method of claim 4 wherein the transfer component initiates the actuating mechanism.

6. The method of claim 5 wherein the actuating mechanism moves the sealing valve.

7. The method of claim 2 wherein the body is adapted to sealably join with the well tubing head.

8. The method of claim 2 wherein:

the transfer component is comprised of a ring piston, the sealing valve is comprised of a gate valve, the actuating mechanism is further comprised of a gate assembly.

9. The method of claim 8 wherein the gate assembly further comprises a spring.

10. The method of claim 2 wherein the body further comprises at least two members further comprising a lower body and an upper body.

11. The method of claim 10 wherein the at least two members further comprises a hanger neck.

12. The method of claim 2 wherein the sealing valve further comprises a seal body with a radial cross section to engage the well bore production tubing string.

13. The method of claim 2 further comprising a flow body.

14. The method of claim 13 wherein the flow body is sized to fit and align with the well bore production tubing string.

15. The method of claim 14 wherein the flow body is formed to interface with the sealing valve.

16. The method of claim 2 wherein the sealing valve further comprises a seal body assembly.

17. The method of claim 16 wherein the seal body assembly further comprising a workpiece to bias the sealing valve to a closed position.

18. The method of claim 1 wherein the test-port pressure actuated sealing apparatus is biased to a closed position.

19. The method of claim 1 wherein the test-port pressure actuated sealing apparatus seals the well bore production tubing string by extending a seal perpendicular to flow in the well bore production tubing string.

20. The method of claim 1 wherein the application of the introduced pressure through the standard test-port is initiated by a hand operated hydraulic pump with an adapter to join with the standard test-port.

21. The method of claim 1 wherein the building of the introduced pressure within the void space is stopped when the introduced pressure exceeds pressure rising through the well bore production tubing string.

22. The method of claim 1 wherein the method further comprises the following steps to unseal the well bore production tubing string:

bleeding the introduced pressure back through the standard test-port, applying neutralizing pressure into the well tubing head above the tubing hanger permitting a coil spring within the tubing hanger to actuate the test-port pressure actuated sealing apparatus to open the well bore production tubing string.

23. A method of sealing a well bore production tubing string at a well tubing head comprising the following steps:

installing a test-port actuated sealing apparatus in a tubing hanger in-line with the well bore production tubing string, applying an external pressure through a void space occurring between the well tubing head and the test-port actuated sealing apparatus, the void space having fluid communication with a standard test-port, continuing the application of the external pressure until the external pressure reaches a level greater than well pressure pressing up from the well bore production tubing string, and whereby the external pressure actuates the test-port actuated sealing apparatus to seal the well bore production tubing string at the well tubing head.

24. A method of sealing a well bore production tubing string using a combination of a well tubing head and a tubing hanger in line with the well bore production tubing string and comprising a test-port actuated sealing apparatus, wherein installation of the tubing hanger within the well tubing head creates a void space in fluid communication with a well tubing head test-port, such that the test-port actuated sealing apparatus of the tubing hanger is in fluid communication with the void space and that pressurization of the void space provides actuation to the test-port actuated sealing apparatus of the tubing hanger to seal the well bore production tubing string.

* * * * *